US005187948A

United States Patent [19]

Frohbieter

[11] Patent Number: 5,187,948

[45] Date of Patent: Feb. 23, 1993

[54] CLEAR CUBE ICE MAKER

[75] Inventor: Edwin H. Frohbieter, Lincoln Township, Berrien County, Mich.

[73] Assignee: Whirlpool Corporation, Benton Harbor, Mich.

[21] Appl. No.: 815,970

[22] Filed: Dec. 31, 1991

[51] Int. Cl.[5] ..... F25C 1/12

[52] U.S. Cl. ..... 62/351; 62/353

[58] Field of Search ..... 62/351, 353, 340, 405

[56] References Cited

U.S. PATENT DOCUMENTS

| | | | |
|---|---|---|---|
| 2,900,804 | 8/1959 | Rising | 62/157 |
| 3,146,606 | 9/1964 | Grimes et al. | 62/233 |
| 3,364,394 | 1/1968 | Cohen et al. | 62/405 X |
| 3,380,261 | 4/1968 | Hendrix et al. | 62/352 X |
| 3,418,823 | 12/1968 | Vivai | 62/353 X |
| 3,433,030 | 3/1969 | Jacobs | 62/186 |
| 3,482,413 | 12/1969 | Mann et al. | 62/68 |
| 3,526,100 | 9/1970 | Briel | 62/340 X |
| 3,791,166 | 2/1974 | Maleck | 62/138 |
| 4,009,595 | 3/1977 | Barnard et al. | 62/300 |
| 4,045,979 | 9/1977 | Mazzini | 62/352 |
| 4,184,339 | 1/1980 | Wessa | 62/68 |
| 4,199,956 | 4/1980 | Lunde | 62/352 X |
| 4,207,750 | 6/1980 | Simkens | 62/352 X |
| 4,706,465 | 11/1987 | Searl | 62/353 X |

FOREIGN PATENT DOCUMENTS 4012249 10/1991 Fed. Rep. of Germany .

*Primary Examiner*—William E. Tapolcai

*Attorney, Agent, or Firm*—Wood, Phillips, VanSanten, Hoffman & Ertel

[57] ABSTRACT

An ice maker for use in a domestic refrigerator/freezer makes clear ice bodies. The ice maker comprises a support arranged to have an ice body formed thereon. The support is refrigerated to a below-freezing temperature and a container adapted to hold a body of water is moved to move liquid water contained therein uniformly about the support suitable to cause a clear substantially symmetrical ice body to build up outwardly on the refrigerated support.

33 Claims, 12 Drawing Sheets

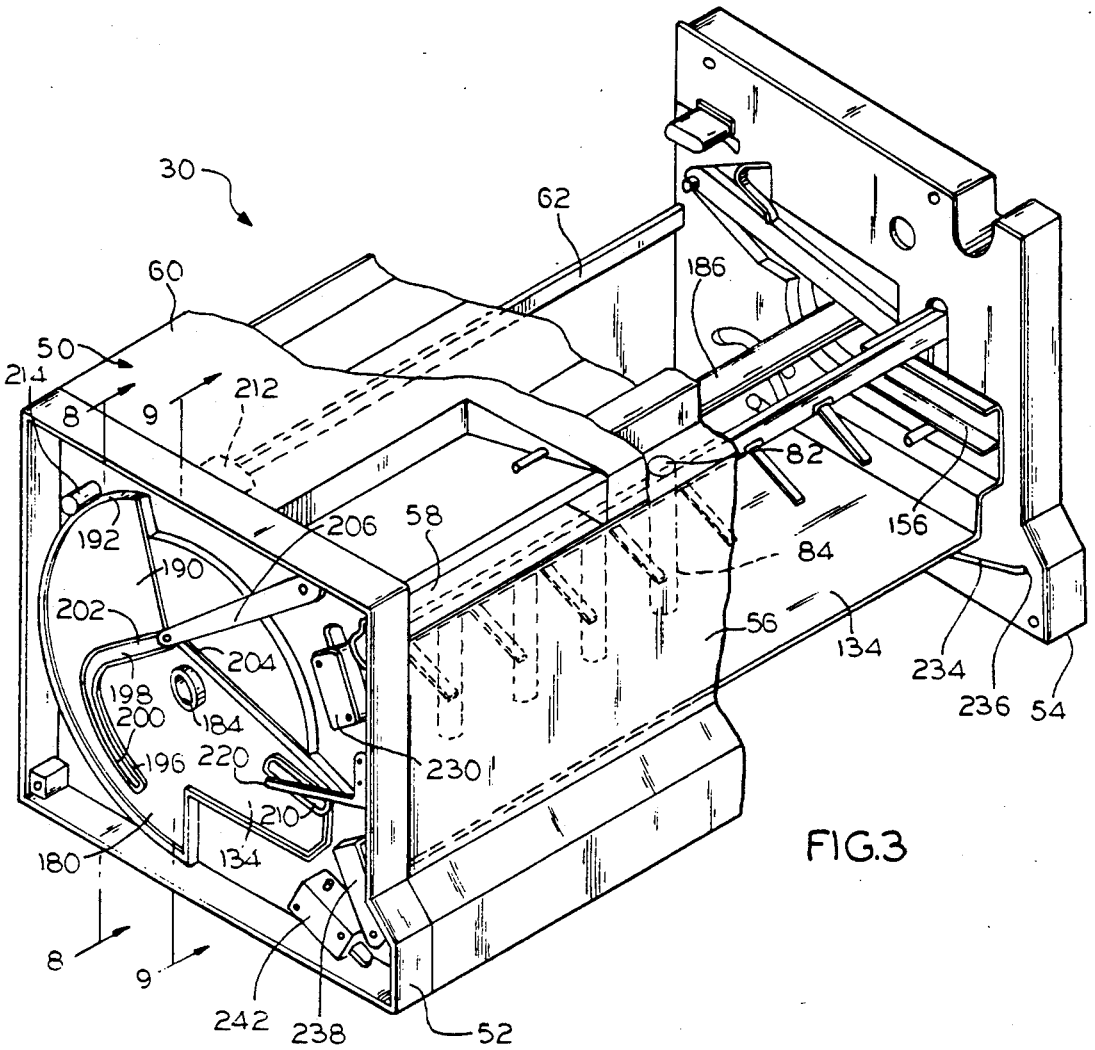
FIG.3
FIG.21
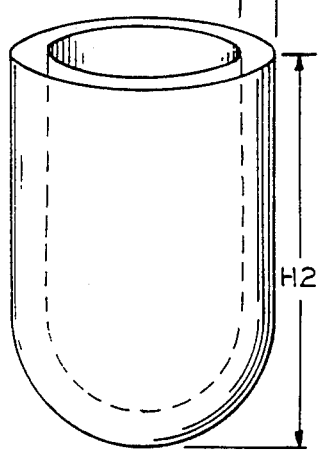
FIG.19
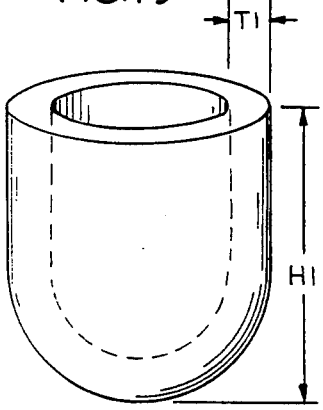
FIG.20
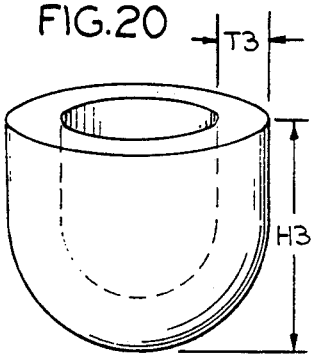

CLEAR CUBE ICE MAKER

FIELD OF THE INVENTION

This invention relates to ice makers and, more particularly, to a clear cube ice maker for use in a refrigeration apparatus.

BACKGROUND OF THE INVENTION

Commercial ice makers have long been available for producing clear ice. A typical such ice maker is illustrated in Barnard U.S. Pat. No. 4,009,595 owned by the assignee hereof. Such an ice maker is intended for producing ample quantities of ice bodies and is not readily adaptable for use in a domestic refrigerator. Moreover, such an ice maker differs from those in domestic refrigerators in that it does not utilize a below-freezing compartment for maintaining the ice bodies in a frozen condition.

Ice makers for domestic refrigerator/freezers may produce ice bodies that are cloudy. This results from the ice bodies being formed in a tray wherein gases are trapped in solution in the freezing water. The commercial type ice makers discussed above produce clear ice because freezing proceeds from a cold surface into a water bath so that the freezing ice-water interfaces a surface from which gases coming out of solution can escape.

Because the storage bin in a domestic refrigerator/-freezer is contained in the freezer compartment, ice bodies are stored at below-freezing temperature. In order to prevent icing together of separate ice bodies it is necessary that the ice bodies must have dry surfaces when placed into the storage container.

The present invention is intended to overcome the problems discussed above.

SUMMARY OF THE INVENTION

In accordance with the invention there is disclosed an ice maker for a refrigerator/freezer for making clear ice bodies.

Broadly, there is disclosed herein an ice maker for making clear ice bodies comprising a support arranged to have an ice body formed thereon, means for refrigerating the support to a below-freezing temperature and a container adapted to hold a body of water. Means are provided for moving the container to move liquid water contained therein uniformly about the support suitable to cause a clear substantially symmetrical ice body to build up outwardly on the refrigerated support. Means are provided for causing repositioning of the container to withdraw the water in the container from adjacent the support, and means for causing harvesting of the ice body from the support.

It is a feature of the invention that the support comprises a hollow member and the means for refrigerating the support comprises means for conducting a refrigerated fluid therethrough.

It is another feature of the invention that the support comprises a depending member and the container comprises an upwardly opening container.

It is a further feature of the invention that the means for moving the container comprises means for reciprocating the container.

It is still another feature of the invention that the support comprises a depending member and the container comprises an upwardly opening container and the means for moving the container comprises means for vertically reciprocating the container.

It is another feature of the invention that the means for causing harvesting of the ice body comprises means for heating the support.

It is yet another feature of the invention that the means for causing harvesting of the ice body comprises pressure means for urging the ice body from the support.

It is still another feature of the invention that the means for causing harvesting of the ice body comprises resilient pressure means for urging the ice body from the support.

It is an additional feature of the invention that there is provided means for dumping the water from the container after a preselected number of ice body making cycles of operation of the ice maker.

It is yet another feature of the invention that means are provided for collecting the harvested ice bodies and means for dumping the water from the container as an incident of the collecting means having a preselected full level of ice bodies therein.

It is still a further feature of the invention that the ice forming portion comprises a tubular member and the means for refrigerating the ice forming portion comprises means for conducting refrigerated fluid therethrough.

It is still a further feature of the invention that the ice forming portion comprises a tubular member and the means for causing harvesting of the ice body comprises pressure means movable coaxially of the tubular member for urging the ice body therefrom.

It is still an additional feature of the invention that there is included means for drying the outer surface of the ice body subsequent to the ice body being freed of contact with the liquid water.

It is still a further additional feature of the invention that the means for drying the outer surface of the ice body comprises means for contacting the outer surface with air at a temperature below 32° F.

It is still yet another feature of the invention that the means for moving liquid water about the ice forming portion includes means for utilizing the same water to form a plurality of ice bodies seriatim and means for replacing the water with fresh water after a preselected number of ice bodies have been formed from the water.

It is still yet a further feature of the invention that there is included a collection receptacle for receiving the harvested ice bodies and means for replacing the water with fresh water after a preselected number of ice bodies have been formed from the ice-water as an incident of a preselected number of harvested ice bodies being contained in the collection receptacle.

There is disclosed in accordance with another aspect of the invention an ice maker for making clear ice bodies comprising a support arranged to have an ice body formed thereon, means for refrigerating the support to a below-freezing temperature and a container adapted to hold a body of water. Means are provided for reciprocally, vertically moving the container to move liquid water contained therein uniformly about the support suitable to cause a clear substantially symmetrical ice body to build up outwardly on the refrigerated support. Means are provided for causing repositioning of the container to withdraw the water in the container from adjacent the support and means for causing harvesting of the ice body from the support including means for firstly freeze drying the outer surface of the ice body and subsequently warming the support to free the ice body therefrom.

There is disclosed in accordance with a further aspect of the invention an ice maker for making clear ice bodies comprising a support arranged to have an ice body formed thereon, comprising a hollow plastic tubular member opened at a near end and closed at a distal end. Refrigeration means are provided for conducting refrigerated fluid through the open end of the tubular member to refrigerate the support to a below-freezing temperature. A container is adapted to hold a body of water and means are provided for moving the container to move liquid water contained therein uniformly about the support suitable to cause a clear substantially symmetrical ice body to build up outwardly of the refrigerated support adjacent the closed end of the tubular member.

It is a feature of the invention that the refrigeration means comprises means for conducting refrigerated air through the tubular member.

It is another feature of the invention that the refrigeration means comprises means for drawing refrigerated air from outside of the ice maker.

It is disclosed in accordance with still a further aspect of the invention an ice maker for making clear ice bodies comprising a support arranged to have an ice body formed thereon, means for refrigerating the support at a below-freezing temperature and a container adapted to hold a body of water. Means are provided for moving the container to move liquid water contained therein uniformly about the support suitable to cause a clear substantially symmetrical ice body to build up outwardly on the refrigerated support Means are provided for heating the container to prevent freezing of water contained therein. Means are also provided for causing harvesting of the ice body from the support.

It is a feature of the invention that the heating means includes a control for operating the heating means only during a time period when the moving means moves the container to move liquid about the support.

It is another feature of the invention to provide storage means for causing repositioning of the container to withdraw the water in the container from adjacent the support prior to harvesting of the ice body.

It is still a further feature of the invention that the heating means includes a control for disabling the heating means during a time period when the storage means repositions the container to withdraw water from adjacent the support.

It is still a further feature of the invention that the moving means comprises a tray carrier supporting the container, the carrier including support pins received in a track defining a path of movement of the carrier, and a drive controlling movement of the carrier.

It is a further feature of the invention that the pins comprise conductive pins and the heating means comprises an electrical heater connected to the pins.

It is still a further feature of the invention that there is provided electrical power terminals positioned at a select location of the tracks to control operation of the heating means incident to the carrier being at a select position at the select location.

There is disclosed in accordance with still a further aspect of the invention an ice maker for making clear ice bodies comprising a support arranged to have an ice body formed thereon, means for refrigerating the support to a below-freezing temperature and a container adapted to hold a body of water. Cycle means are provided for moving the container to move liquid water contained therein uniformly about the support suitable to cause a clear, substantially symmetrical ice body to build up outwardly on the refrigerated support. Storage means are provided for causing repositioning of the container to withdraw the water in the container from adjacent the support. Control means are provided for controlling operation of the cycle means and the storage means and operable to operate the cycle means for a select time duration prior to operation of the storage means during a batch operation of the ice maker.

It is a feature of the invention that the control means includes means for sensing temperature of the ice maker and adaptive control means for varying the select time duration responsive to sense temperature to provide uniform sized ice bodies in different batch operations of the ice maker.

Further features and advantages of the invention will be readily apparent from the specification and from the drawings.

BRIEF DESCRIPTION OF THE DRAWINGS

FIG. 3 is a partial perspective view, with parts removed for clarity and shown in cutaway of the ice maker according to the invention;

FIG. 19 is a perspective view illustrating a normal sized ice body formed with the ice maker of FIG. 3;

FIG. 20 is a partial perspective view illustrating a shorter and thicker ice body as compared to that of FIG. 19;

FIG. 21 is a perspective view illustrating a taller and thinner ice body as compared to that of FIG. 19;

DESCRIPTION OF THE INVENTION

Figure 1:
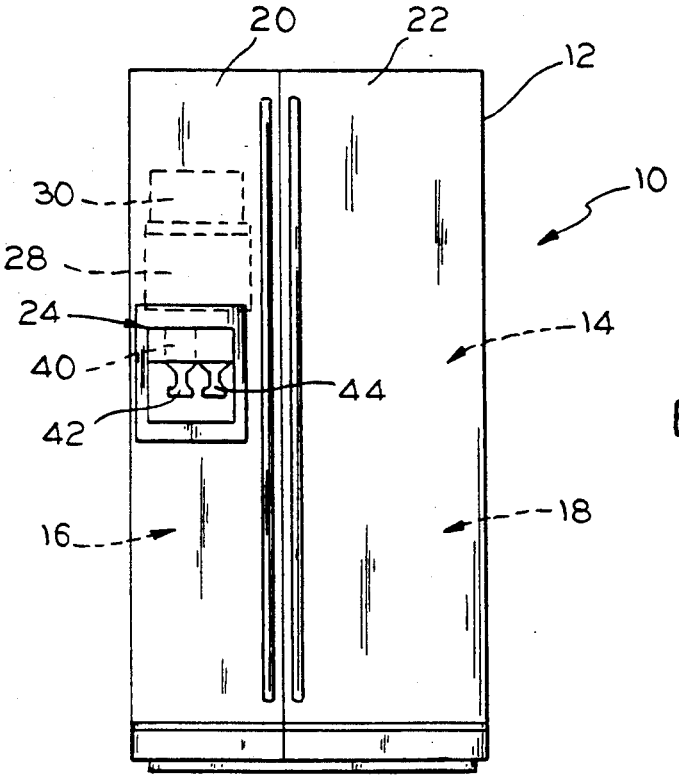
FIG. 1 is a front elevation view showing a refrigeration apparatus including an ice maker according to the invention.

With reference to FIG. 1, a refrigeration apparatus 10, comprising a side-by-side refrigerator/freezer, includes a cabinet 12 housing a storage space 14. Particularly, the storage space 14 comprises a below-freezing, or freezer, compartment 16, and an above-freezing, or fresh food, refrigerator compartment 18. Access to the compartments 16 and 18 is had through respective freezer and refrigerator doors 20 and 22, respectively, hingedly mounted to the cabinets 12, as is well known.

The freezer door 20 is provided with a through-the-door ice dispensing apparatus 24. The dispensing apparatus 24 is partially contained within a housing 26, see FIG. 2, suitably mounted in the freezer door 20.

Figure 2:
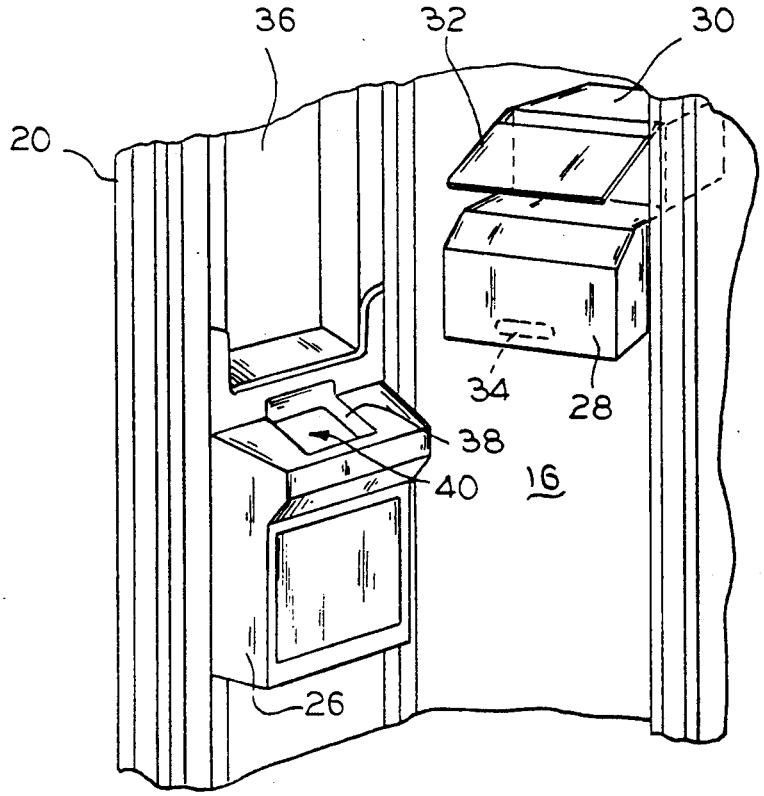
FIG. 2 is a partial perspective view of the refrigeration apparatus of FIG. 1 with a freezer door in an open position.

With reference also to FIG. 2, an ice container assembly 28 in the freezer compartment 16 stores ice bodies which are delivered thereto from a superjacent ice maker 30 according to the invention. A door 32 is hingedly mounted in the freezer compartment 16 to provide selective access to the ice maker 30. The ice container assembly 28 includes a conveyor structure of any known form for conveying ice cubes to a downwardly facing discharge opening 34.

The freezer door 20 includes an interior panel 36 including an opening 38 in communication with an ice chute 40. When the door 20 is in the closed position, the opening 38 is positioned immediately below the container assembly discharge opening 34. Ice bodies may be obtained by placing a suitable container against an actuator 42, see FIG. 1, which opens a closure (not shown) and actuates the ice container assembly 28 to deliver ice bodies to the chute 40 for dispensing. Suitable switching devices are provided for actuating the conveyor structure, as is well known. An additional lever 44 is provided for dispensing chilled water. The structure for doing the same is not specifically disclosed herein as it does not relate to the invention.

Figure 4:
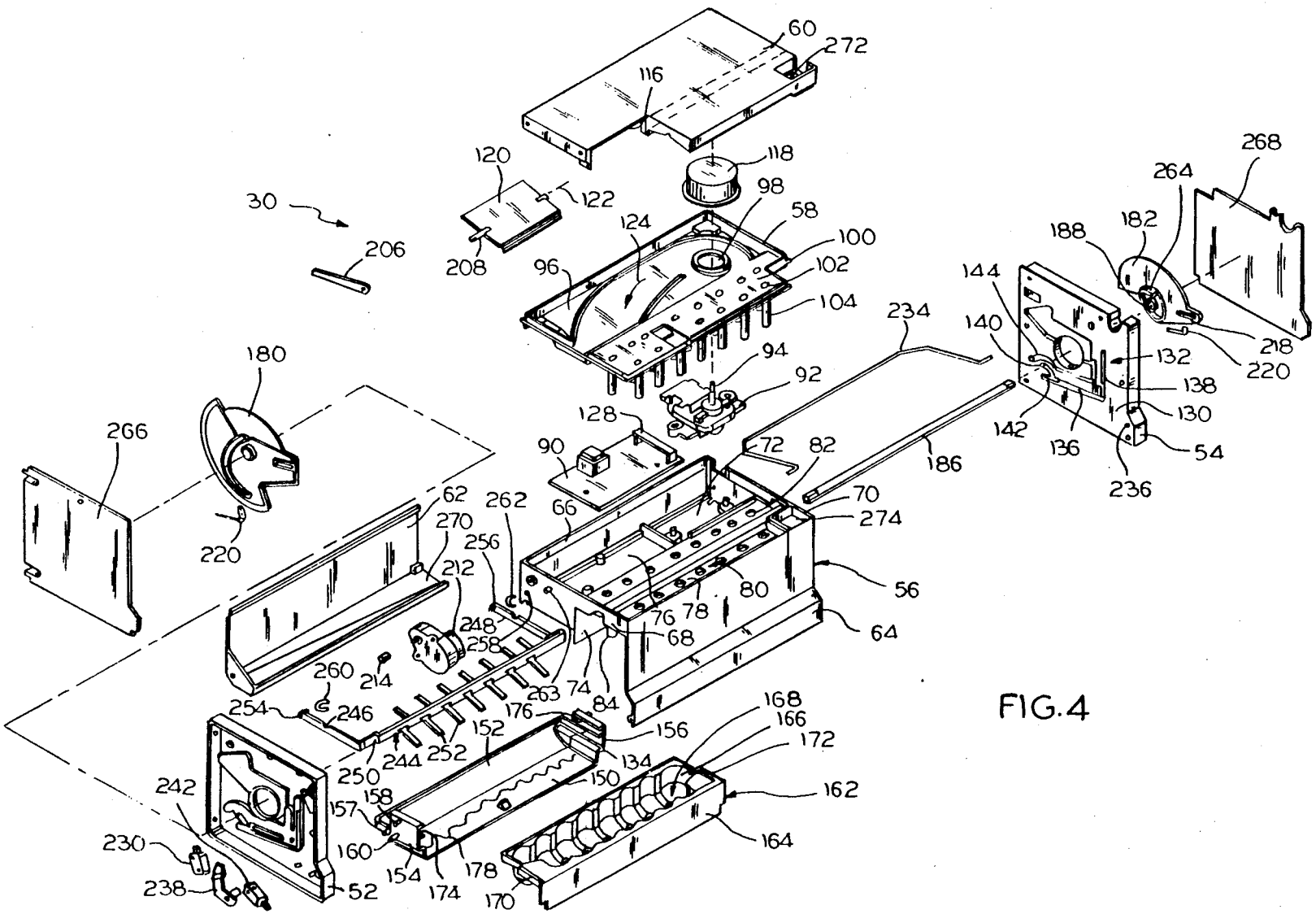
FIG. 4 is an exploded view of the ice maker of FIG. 3.

With reference to FIGS. 3 and 4, the ice maker 30 is illustrated in greater detail. The ice maker 30 provides clear ice by freezing water in a manner such that gases in solution can escape. To provide a smooth ice body with a crystal clear appearance, the ice maker 30 provides a relative motion between the freezing ice and the bulk water volume it is freezing from. This motion polishes the ice surface while it is freezing and mixes the bulk water volume it is freezing from to maintain uniform temperature in the freezing bath. Further, the ice bodies have dry, frozen surfaces when placed into the container assembly 30 to prevent the ice bodies from freezing into a large unusable mass. Finally, the ice maker 30 prevents the water volume from freezing and periodically dumps the same to maintain a usable low solids and salt content freezing bath and to prevent freeze up when it is not making ice.

The ice maker 30 comprises a housing 50 including front and rear wall housings 52 and 54, respectively, sandwiching a lower plenum housing 56. An upper plenum housing 58 is received atop the lower plenum housing 56 and is covered by a top cover wall 60. A rear wall 62 also extends between the front and rear wall housings 52 and 54, respectively, below the lower plenum housing 56.

For simplicity herein, the end of the ice maker defined by the front wall housing 52 is referred to as the front portion as it is positioned front most in the freezer space 16 in use, while the rear wall housing 54 is positioned near a rear wall in the freezer space 16. Similarly, the outside wall 62 is positioned adjacent an outside wall of the freezer space 16, i.e. to the left in FIGS. 1 and 2, while an opposite portion is referred to herein as inside.

Figure 16:
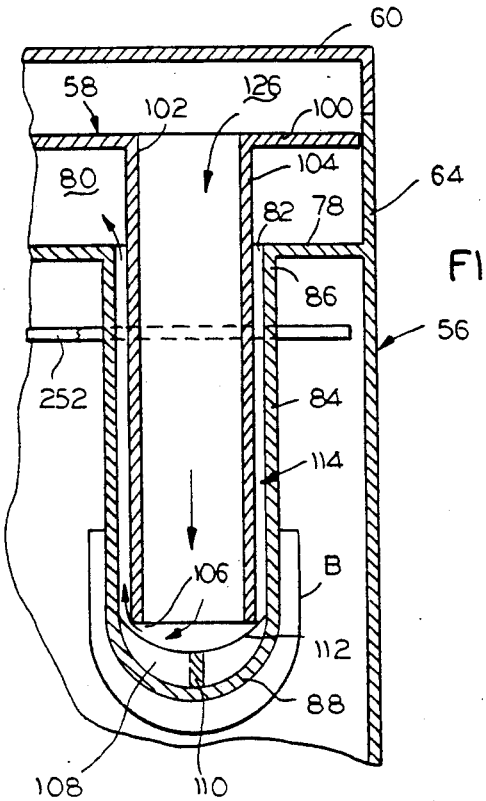
FIG. 16 illustrates air flow paths during a dipping cycle for the formation of an ice body.

The lower plenum housing 56 is of integral plastic construction. The housing 56 includes an inside wall 64 and outside wall portion 66 connected by front and rear walls 68 and 70. A lower wall 72 is connected between the front and rear walls 68 and 70, to the outside wall 66 and to an intermediate wall 74 to define an outer, upwardly opening space 76. A somewhat elevated inside lower wall portion 78 is connected between the intermediate wall 74 and the inside wall 64 and also between the front and rear walls 68 and 70, respectively, and defines an inner, upwardly opening space 80. The lower wall 78 includes a plurality of through openings 82 connected to downwardly depending fingers 84. Particularly, in the illustrated embodiment, there are fifteen openings 82 and connected fingers 84. The fingers 84 comprise supports arranged to have an ice body formed thereon. With reference to FIG. 16, each finger 84 comprises a hollow tubular member open at a top end 86 to the opening 82 and closed at a lower, distal and rounded end 88. The lower end 88 is shaped to provide the configuration for the inside of an ice body B to be formed thereon, as illustrated.

The lower plenum housing outer space 76 houses an electrical control board 90 and blower motor 92 rearwardly thereof The blower motor 92 has an upwardly extending vertical shaft 94.

The upper plenum housing 58 comprises a generally rectangular horizontal wall 96 The wall 96 is of a size and configuration to fit atop the lower plenum housing 56 and between the front and rear walls 68 and 70, respectively, and the inside and outside walls 64 and 66, respectively. The horizontal wall 96 includes an enlarged circular opening 98 having its center corresponding to and for receiving the motor shaft 94. An innermost section 100 of the wall 96 includes a plurality of openings 102. A plurality of hollow, downwardly depending tubes 104 extend from the inner wall portion 100, one at each opening 102, see FIG. 16 Each tube 104 is received in one of the fingers 84 incident to placement of the upper plenum housing 58 on the lower plenum housing 56, as discussed above. Each tube 104 is opened at a lower end 106.

To facilitate alignment of the tubes 104 and the fingers 84, each finger includes a pair of vertical, crisscrossed crescent-shaped walls 108 and 110. An upper arc surface 112 on the walls 108 and 110 centers the tube 104 in the finger 84 to maintain a uniform space 114 therebetween around the entire periphery of the tube 104.

The cover 60 is of a size corresponding to the upper and lower plenum housings 58 and 56, respectively, except for a rectangular cutout 116. Prior to installing the cover atop the lower plenum housing 56, a blower wheel 118 is mounted to the motor shaft 94 above the upper plenum housing wall 96.

A damper 120 is mounted between the cover 60 and the front wall 52 at the opening 116. The damper 120 is pivotal about an axis represented by the line 122 for controlling air flow.

The blower wheel 118 is configured so that suction is present at the upper plenum housing opening 98 and its discharge is as indicated by an arrow 124, see FIG. 4, toward the cover opening 116. With suction at the opening 98, air is drawn from a space 126 between the cover 60 and upper plenum housing wall 100, see FIG. 16, and downwardly through the tube 104. Air exits the tube 104 around its lower end 106 and into the space 114 between the tube 104 and the finger 84 and exits into the space 80 where it returns to the suction side of the blower wheel 118.

Figure 9:
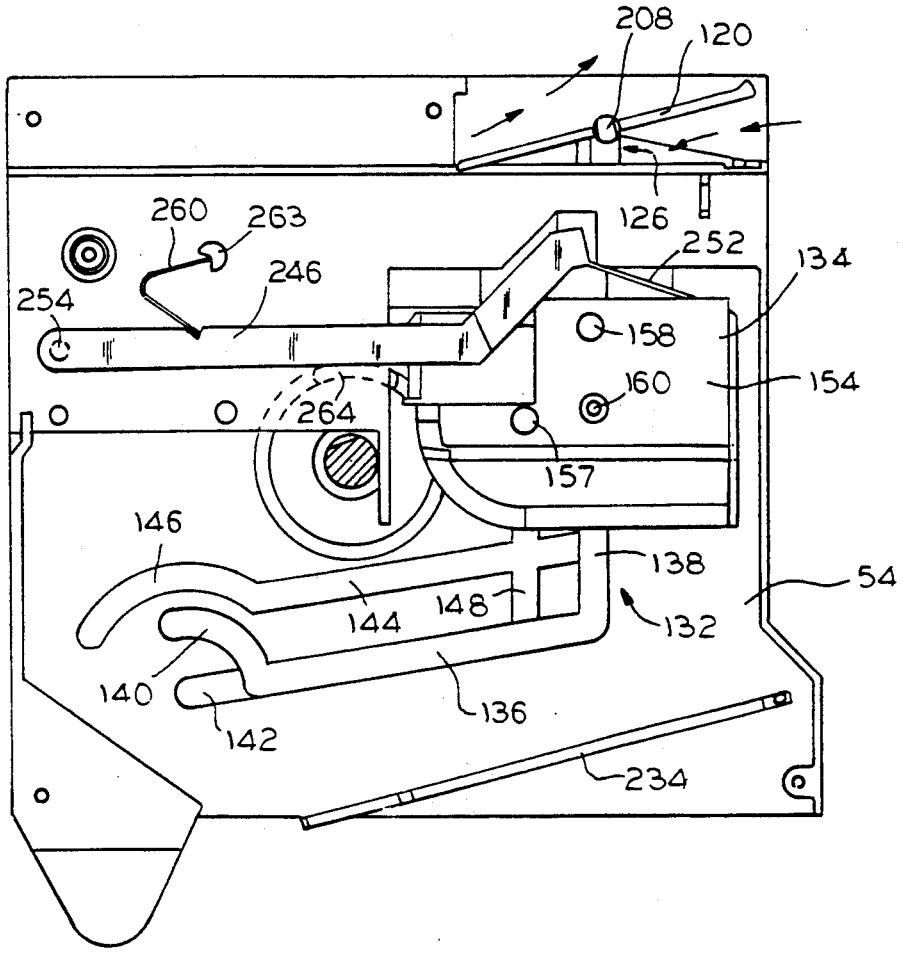
FIG. 9 is a side elevation view taken along the line 9—9 of FIG. 3 with an ice tray support in the top dip position.
Figure 13:
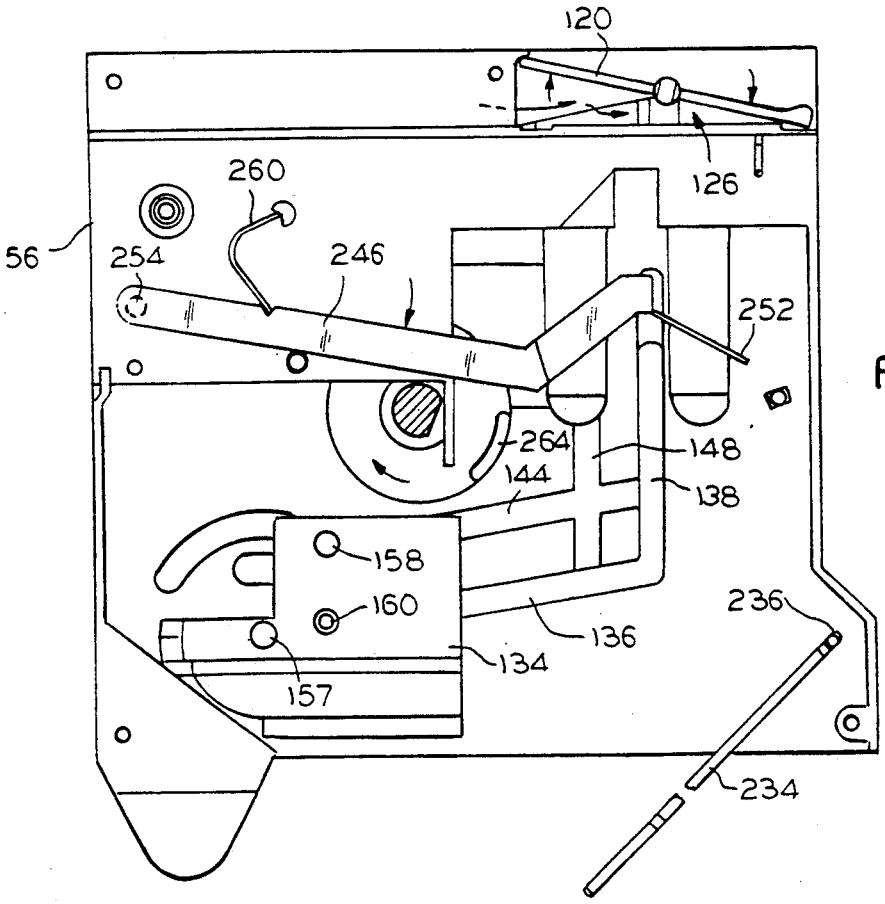
FIG. 13 is a view similar to that of FIG. 9 with the tray support in the harvest and park position.
Figure 14:
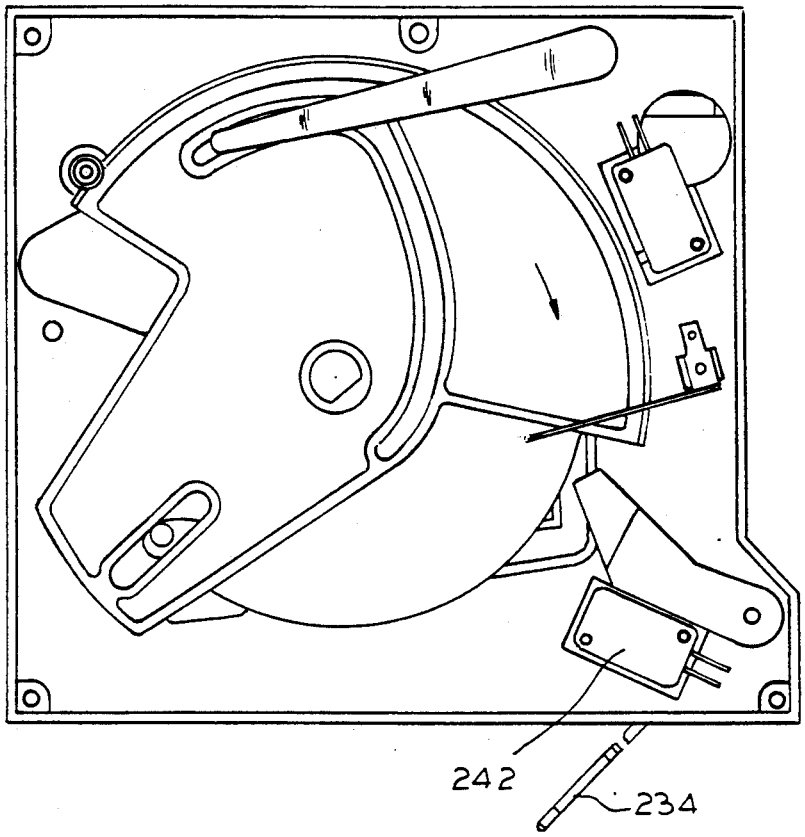
FIG. 14 is a view similar to that of FIG. 8 with the tray support in a dump position.

The source of air flow depends on the position of the damper 120. Particularly, when the damper 120 is in an open position, as illustrated in FIG. 9, air at a below-freezing temperature is drawn into the space 126, as illustrated, so that below-freezing fluid, in the form of refrigerated air, passes through the fingers 84 to refrigerate the same. Exhaust air exits above the damper 120, as illustrated. When the damper 120 is in a closed position, as illustrated in FIG. 13, exhaust from the blower wheel 100 is recirculated into the space 126 so that below-freezing air is not used. In fact, a heater element 128 on the control board 90 is energized during specified operational cycle times when the damper 120 is closed so that the circulating air is heated, as discussed below.

The rear wall housing 54 includes a rear wall 130 formed with a series of front facing tracks 132 for controlling movement of a tray carrier 134. The tracks 132 include a generally horizontal elongate lower through opening 136 connected at an inner end to a vertical through opening 138 and an outer end to an arcuate upwardly extending through opening 140. The lower horizontal opening 136 also continues at its rear end to a counter bored groove 142 below the arcuate opening 140, see FIG. 9. An upper horizontal elongate groove is provided in parallel to the lower opening 136 and is connected to the front vertical opening 138 at its inner end and to an arcuate portion 146 at its outer end. An outer vertical groove 148 is parallel to and spaced outwardly from the inner vertical opening 138. The vertical groove 148 connects at a lower end to the lower horizontal opening 136 and crosses the horizontal groove 144.

Although not specifically described herein, the front wall housing 52 includes a front wall having similar tracks formed therein, albeit a mirror image, facing the tracks 132 on the rear Wall 54 to guide movement of the carrier 134.

The carrier 134 includes a bottom wall 150 connected to a vertical outer wall 152 and front and rear walls 154 and 156, respectively. Extending frontwardly from the front wall 154 are three pins 157, 158 and 160 in a triangular configuration. The lower, innermost pin 160 is longer than the pins 157 and 158, with the pin 158 being directly above the pin 160 and the pin 157 being outwardly thereof to define the obtuse angle vertex of the triangular configuration. Although not specifically discussed, the rear wall 156 includes a similar array of pins extending rearwardly therefrom.

The carrier 134 is received between the front wall housing 52 and the rear wall housing 54, as shown in FIG. 3. Particularly, the pins are received in the tracks 132 for guiding movement. This relationship can be best understood with reference initially to FIG. 9 when viewing the position of the pins 157, 158 and 160 relative to the tracks 132 of the rear housing wall 54.

Figure 15:
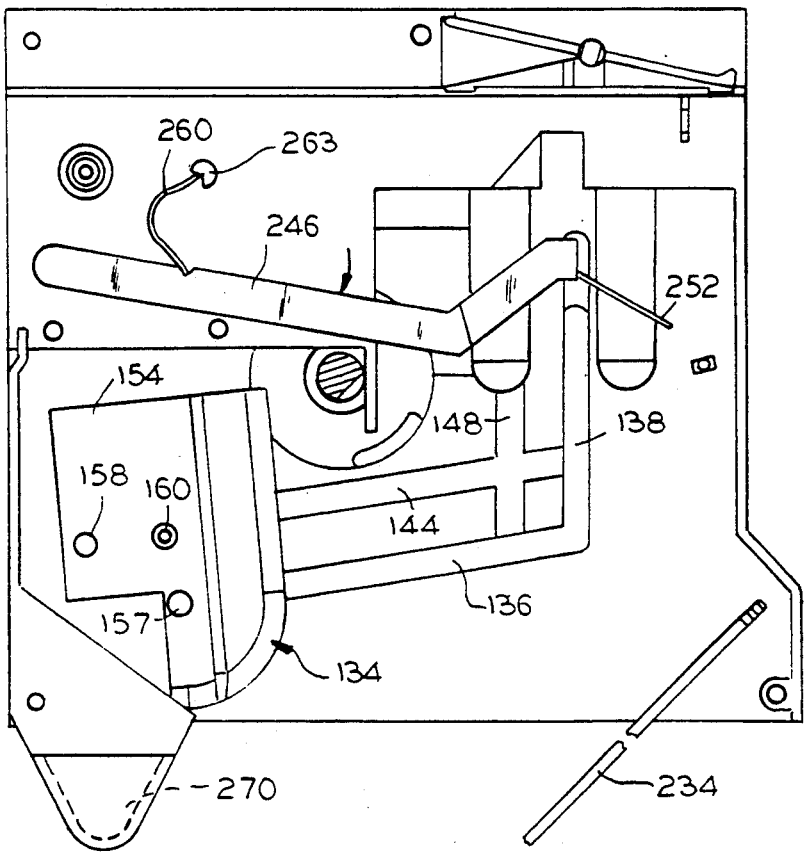
FIG. 15 is a view similar to that of FIG. 9 with the tray support in the dump position.

The pin 160, being longer than the pins 157 and 158 extends through either the approximately horizontal opening 136 or the vertical opening 138. Indeed, the pin 160 is driven by a structure described below to control movement of the carrier 134. The pins 157 and 158 are received in the tracks to maintain the carrier 134 in a desired orientation. During vertical movement of the carrier 134, the pins 157 and 158 are received in the respective vertical groove 148 and vertical through opening 138, as illustrated in FIG. 9. During horizontal movement of the carrier 134, the upper pin 158 is received in the upper groove 144 while the lower pin 157 is received in the lower approximately horizontal through opening 136, as illustrated in FIG. 13. During a dump cycle, the upper pin 158 is received in the upper arcuate groove 146, while the lower pin 157 is received in the lower substantially horizontal groove 142 to tip the carrier 134, as illustrated in FIG. 15.

A water tray 162 is carried on the support 150 and includes an inner wall 164 connected to a formed housing 166 defining an upwardly opening space 168 to be filled with a volume of water. The space 168 is large enough to accommodate the fifteen fingers and provide ample space around each finger for the formation of an ice body, as described below. Front and rear ridges 170 and 172, respectively, are receivable in facing tracks 174 and 176 in the carrier front and rear walls 154 and 156, see FIG. 4.

In order to prevent freezing of water stored in the space 168, a resistance heater wire 178 is supported on the carrier bottom wall 150 between the tray carrier 134 and the tray 162. The resistance heater wire 178 is connected to the rod 160 at each end which comprises a conductive pin for connection to an electrical circuit as discussed below.

To control movement of the carrier 134, front and rear cams 180 and 182 are used. The front cam 180 is positioned in the front wall housing 52 and the rear cam 182 is positioned in the rear wall housing 54, as illustrated.

With reference to FIG. 3, the front cam 180 is generally circular in configuration and includes a central opening 184 for receiving a shaft 186 connecting the front cam 180 to the rear cam 182 at an opening 188, see FIG. 4. The front cam 180 includes a generally semi-circular section 190 having an outer circumferential, toothed surface 192. An elongate arm portion 194 extends from the semi-circular portion 190 in a quadrant clockwise from the circular portion as viewed in FIG. 3. A continuous ridge 196 extending frontwardly from the cam 180 defines an elongate groove 198 including a circumferential portion 200 generally parallel to the outer toothed wall 192 and connected to a curved radially inwardly directed portion 202. The groove 198 receives a pin 204 on an arm 206 which connects to a pin 208 on the damper 120 for controlling positioning of the same.

Figure 8:
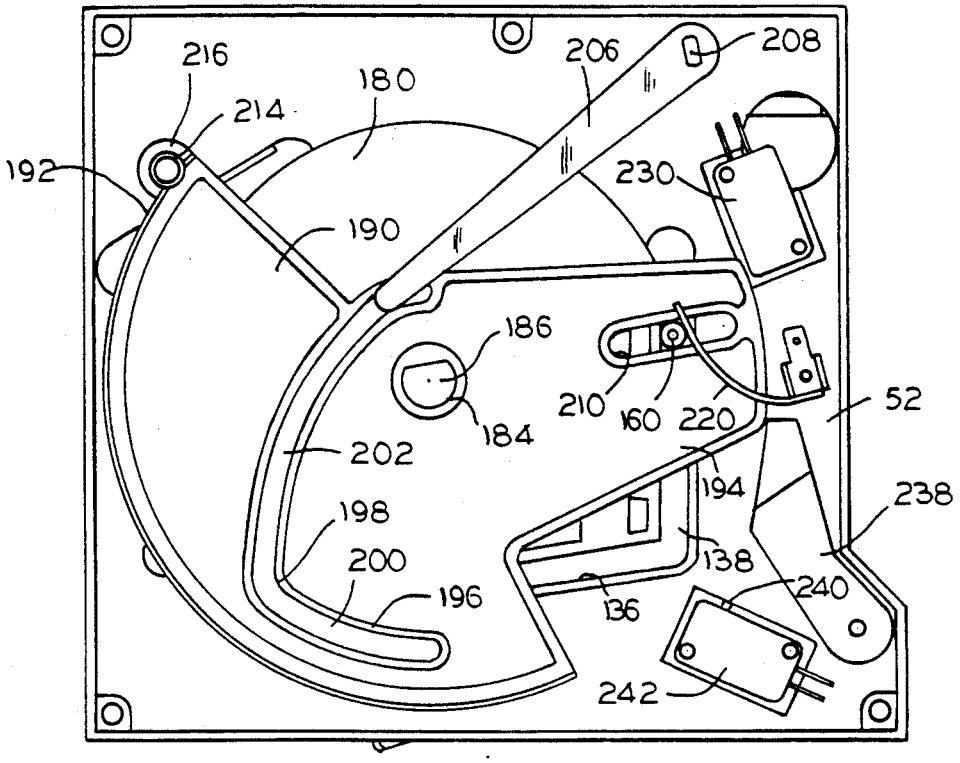
FIG. 8 is a front elevation view taken along the line 8—8 of FIG. 3 with an ice tray support in a top dip position.

The cam arm portion 194 includes a radially extending through slot 210 spaced from the central opening 184. The through slot 210 receives the longer, conductive pin 160 from the carrier 134, as illustrated in FIG. 8.

The front cam 180 is driven by a synchronous motor 212 driving a gear 214 extending through an opening 216 in the front wall housing 52. Particularly, the gear 214 engages the toothed outer surface 192 to rotate the cam 80 about an axis of the shaft 186. Rotational movement of the front cam 180 is converted to linear movement of the pin 160 guided in the openings 138 and 136. Rotation of the shaft 186 also drives the rear cam 182. The rear cam 182 is generally semi-circular in shape and also includes an elongate radial slot 218 for receiving a conductive pin 160 from the rear wall 156 of the carrier 134. Thus, the motor 212 is operable to drive the carrier 134 at both ends using the cams 180 and 182 to provide controlled, uniform movement of the carrier 134 and the tray 162.

To operate the heater, a pair of spring switch blades 220 are used, one associated with the front cam 180 and the other the rear cam 182. As illustrated in FIG. 3, one blade 220 is mounted to the front wall housing 52 so that it extends across the inner vertical slot 138 about a central portion thereof. As particularly illustrated in FIG. 8, the conductive pin 160 extends through the vertical slot 138 and the cam slot 210. When the pin 160 is in the vertical opening 138 about its midpoint, it is engaged by the blade 220. Although not specifically illustrated, a similar connection is provided at the rear wall housing 54. Thus, when power is applied to the spring blades 220 and the carrier 134 is in the suitable position, the heater wire 178, see FIG. 4, is energized.

Figure 10:
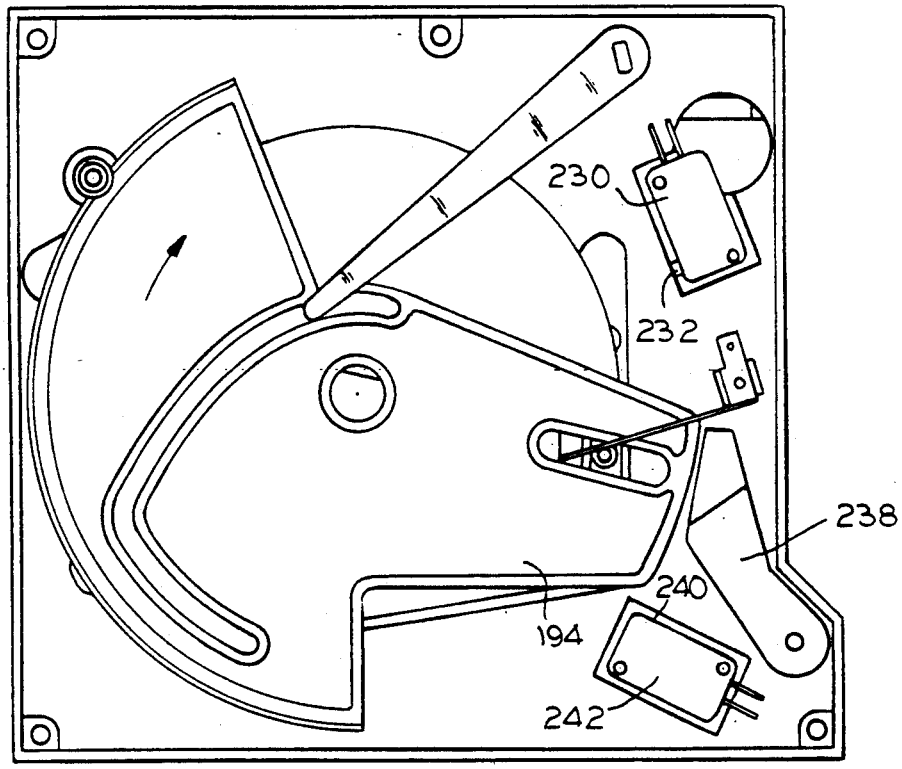
FIG. 10 is a view similar to that of FIG. 8 with the tray support in a bottom dip position.

In order to sense a reference or zero position of the cam 180, a zero reference switch 230 is mounted in the front wall housing 52 in an upper right-hand corner as viewed in FIG. 3. The switch 230 includes an actuator 232, see FIG. 10, actuated by the cam arm 194 when the carrier 134 is in a top dip position.

When the container assembly 28, see FIGS. 1 and 2, is full of ice bodies, it is desirable to prevent further operation of the ice maker 30. In accordance therewith, a bin arm 234 is provided for sensing the level of ice bodies. The bin arm 234 is pivotally mounted to the rear wall housing 54 as at an opening 236 and through a similar opening in the front wall housing 52 where it is mounted to a lever 238. The lever 238 is supported in an "up" position when the carrier 134 is controlled for vertical movement, as by the arm portion 194 being at approximately a "four o'clock" position, see FIGS. 8 and 10. The lever is released when the carrier 134 is controlled for horizontal movement, as by the arm portion 194 being at approximately a "seven o'clock" position, see FIG. 12. When the lever 238 is released, it actuates an actuator 240 of a bin arm switch 242.

In order to facilitate harvesting of ice bodies from the fingers 84, a stripper 244, see FIG. 4, is used. The stripper 244 includes front and rear arms 246 and 248, respectively, connecting a cross bar 250. Extending transversely from the cross bar 250 are a plurality of oppositely directed, flexible stripper blades 252. Outer ends of the arms 246 and 248 include respective pins 254 and 256 received for pivotal movement in apertures, one of these apertures 258 being illustrated in the lower plenum housing 56. Each stripper blade is positioned alongside one finger 84. A spring 260, and a spring 262 on the opposite end, are each associated with a pin 263 on opposite ends of the plenum housing 56 and the respective arms 246 and 248 for biasing the stripper 244 downwardly, as illustrated in FIG. 9. The rear cam 182 includes a frontwardly directed cam actuator 264 for bearing on the stripper arm 248 to force the same upwardly when the cams are rotated for providing vertical reciprocal movement of the tray carrier 134. Although not shown, the front cam 180 includes a similar cam actuator.

When assembled, the front and rear wall housings 52 and 54 are fastened to the lower housing plenum 56 using suitable fasteners (not shown). Front and rear cover plates 266 and 268, see FIG. 4, are subsequently fastened to their respective housings 52 and 54 to cover the same.

The outer wall 62 includes a lower, rearwardly and downwardly directed trough 270 for dumping water when necessary. When installed in a freezer compartment, a rear portion of the trough is positioned adjacent suitable apparatus for disposing of such water.

In order to fill the tray 162 with water an opening 272 is provided through the cover 60 at a rear inner corner thereof communicating with similar opening 274 in the lower plenum housing 56 positioned above the tray 162. Although not shown, a hose would be positioned in such opening and connected via a solenoid valve to a source of water for filling the tray 162 as necessary.

Figure 5:
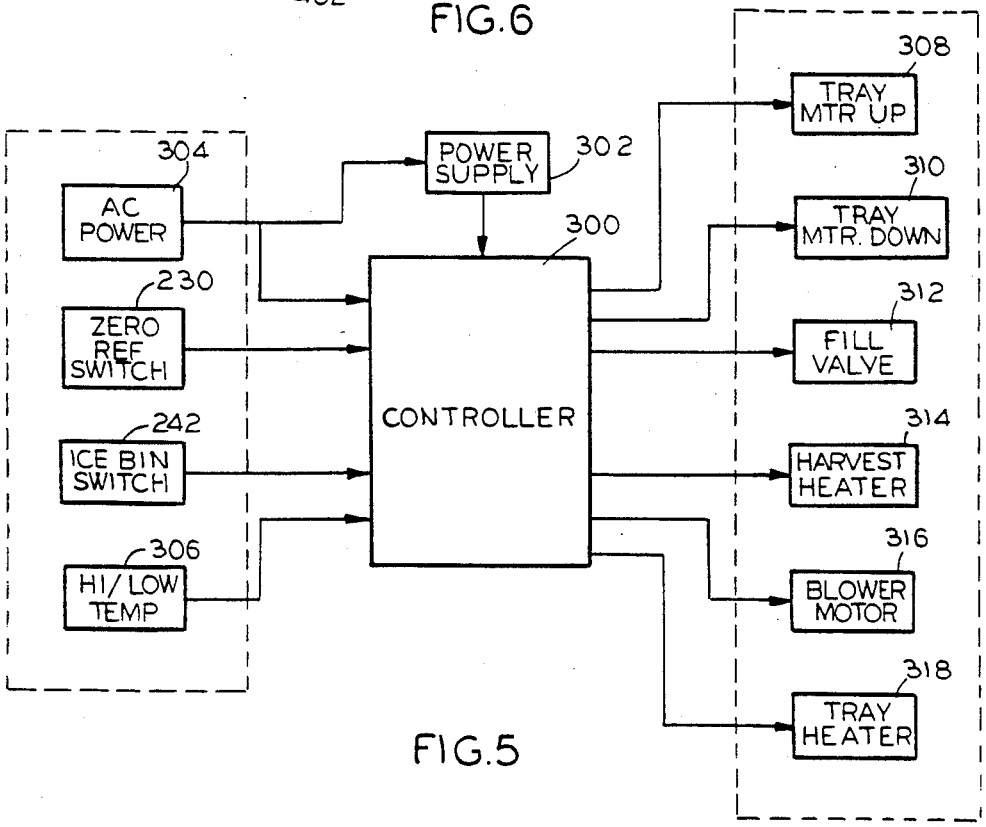
FIG. 5 is a block diagram illustrating a control for the ice maker of FIG. 3.

With reference to FIG. 5, a block diagram illustrates an electrical control used for operating the ice maker 30 A controller circuit represented by a block 300 receives power from a power supply 302 supplied by an AC power source. Other inputs to the controller 300 include discrete inputs from the zero reference switch 230 and the ice bin arm switch 242 and a temperature sensor 306. The sensor 306 is mounted on the circuit board 90 and senses air temperature. The controller in turn controls the tray motor 212 via two outputs, represented by blocks 308 and 310. The block 308 receives a command for operating the motor to move the tray 162 upwardly, while the block 310 represents an output for moving the tray 162 downwardly. An output block 312 operates the fill valve used for filling the tray 162. An output block 314 operates the harvest heater 128, see FIG. 4. An output block 316 operates the blower motor 92 while an output block 318 operates the tray heater wire 178.

Figure 6:
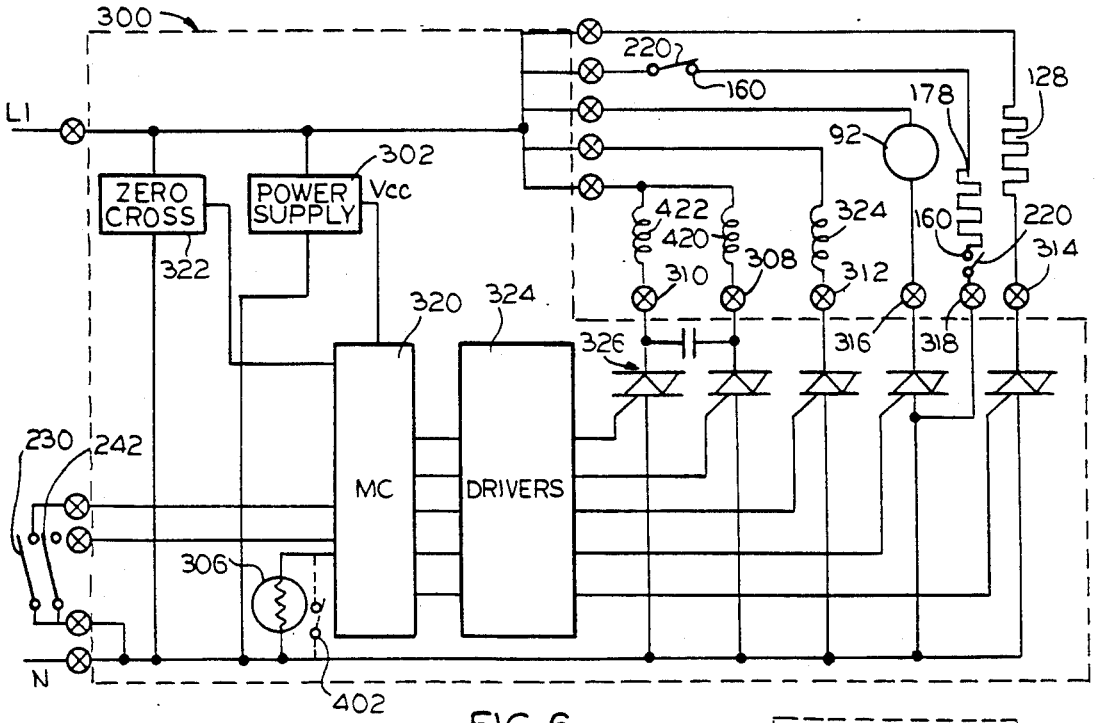
FIG. 6 is an electrical schematic illustrating a circuit for implementing the block diagram of FIG. 5.

With reference to FIG. 6, a schematic diagram illustrates the control of FIG. 5 in circuit form. AC power is provided across terminals labelled L1 and N to the controller 300. The switches 230 and 242 and the temperature sensor 306, represented by a negative temperature coefficient sensing thermistor, are connected to a microcontroller 320. The microcontroller includes a suitable processor and memory circuits as is conventional for connection to the inputs. A zero crossing detector 322 is connected across the power terminals and provides a discrete input to the microcontroller 320 for counting cycles of input power. Particularly, since the tray motor 212 is a synchronous motor, the cycle count is used to determine the amount of rotational movement driven by the motor 212 and thus linear movement of the tray 162. Outputs from the microcontroller 320 are controlled by a driver circuit 324 which drives a plurality of SCR's 326 for controlling the output devices discussed above. As illustrated, only five SCR's 326 are illustrated. The tray heater output 318 directly connects power to the switch blades for energizing the wire 178 whenever the carrier 134 is positioned for vertical movement, as discussed above. The valve output 312 connects to a valve solenoid 324. The motor outputs 308 and 310 connect to oppositely wound coils 420 and 422, respectively, of the motor 212 to control the same in opposite directions.

Figure 7:
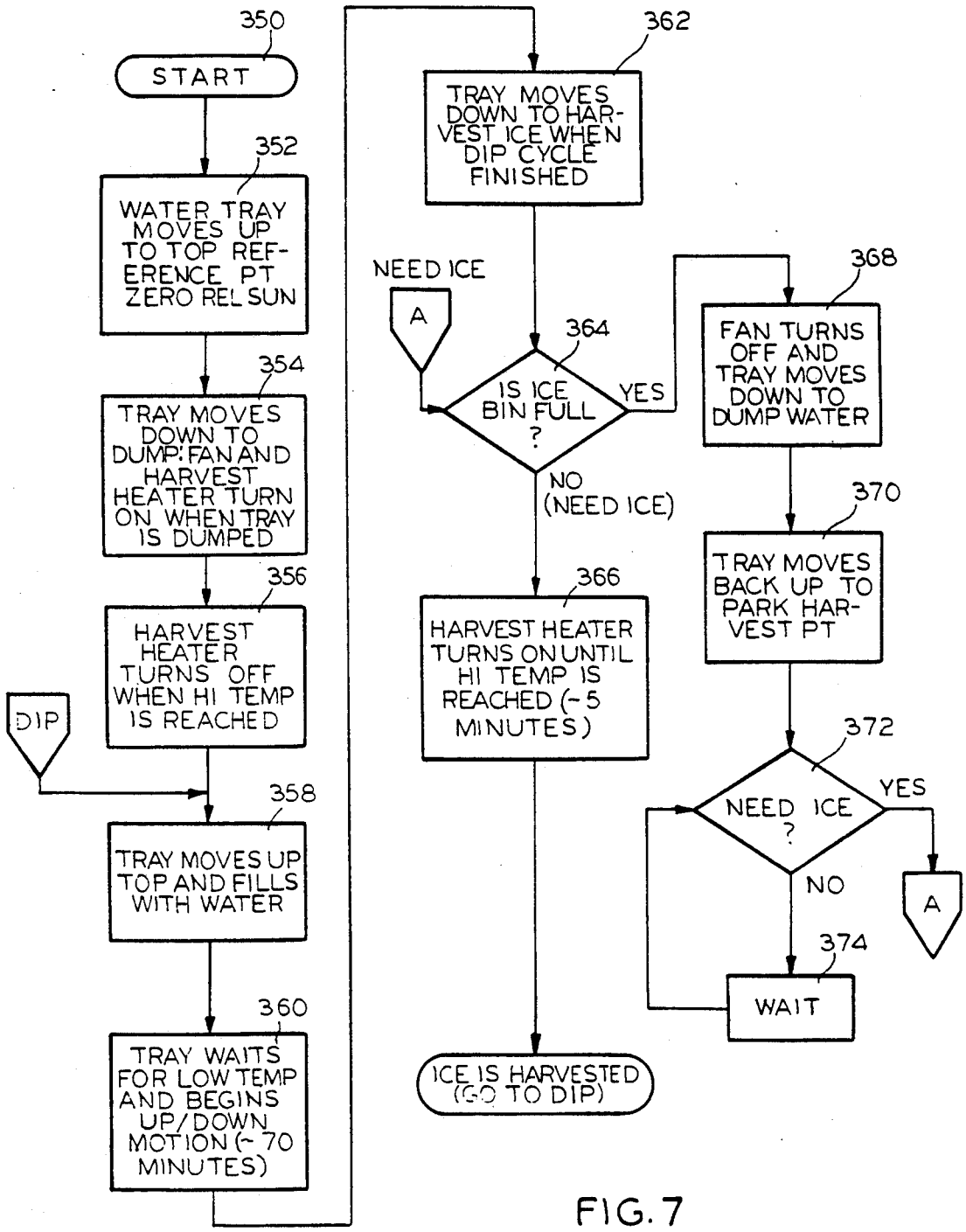
FIG. 7 is a flow diagram illustrating operation of a program in the microcontroller of FIGS. 5 and 6.

The microcontroller 320 operates in accordance with a control program stored in a self-contained memory. The control program sense status of the various inputs and controls operation of the output devices. A flow diagram for the control program is illustrated in FIG. 7.

The control program begins at a start node 350 at power up or subsequent to a refrigerator defrost cycle. Control initially begins at a block 352 at which the tray motor up output 308 is driven high to move the front cam 180 counterclockwise as illustrated in FIG. 8 until the zero reference switch 230 is actuated at which time the tray motor "up" output 308 is deenergized. This sets a start or reference position for subsequent operation. At a block 354, the tray motor "down" output 310 is energized to command movement of the tray 162 downwardly and subsequently outwardly until the tray carrier 134 and thus tray 162 are in the dump position illustrated in FIG. 15. This is done to dump any water that may have remained in the tray 162 while the refrigeration apparatus 10 was off or during a defrost cycle. Once the tray is dumped, then the tray carrier 134 is moved to a park position illustrated in FIG. 13 and the outputs 314 for the harvest heater 128 and 316 for the blower motor 92 are energized. With the tray carrier 134 in the park position, the cam 180 and arm 206 have closed the damper 120, as illustrated in FIG. 13. With the harvest heater 128 energized and the blower motor 92 on, heated air is circulated through the ice maker 30 to ensure that all ice bodies have been harvested and none remains on the fingers 84. Control waits at a block 356 until such time as a high temperature is reached as determined by the thermistor 306 at which time the output 314 to the harvest heater 128 is deenergized. Control then advances to a block 358 to begin a dipping operation.

The dipping operation begins by energizing the tray motor "up" output 308 to energize the motor 212 to move the carrier 134 to the top dip position shown in FIG. 9, as determined by the zero reference switch 230, see FIG. 8. At such time, the fill valve output 312 is energized to open a solenoid valve 324 and fill the tray 162 with a volume of water. With the carrier 134 in the top position, as illustrated in FIG. 9, the damper 120 is controlled by the arm 206 to be in the open position. As a result, freezer air is circulated through the fingers 84. Control waits at a block 360 until a select low temperature is sensed by the thermistor 306 indicating that the finger temperature is cold enough to begin operation. Subsequently, the tray motor "up" and "down" outputs 308 and 310 are alternately operated for a preselect period of time to move the tray up and down between the top dip position shown in FIG. 9 and a bottom dip position shown in FIG. 11.

Particularly, the microcontroller 320 counts the number of pulses input from the zero cross detector 322 to determine vertical movement of the tray 162. In an exemplary embodiment of the invention, the movement of the tray up and down is approximately three-fourths of an inch which may represent approximately fifteen seconds of operation of either the tray motor up output 308 or tray motor down output 310. In order to prevent jam ups, the zero reference switch is utilized periodically, such as, for example, every three dip cycles to reset the programmable counters which count zero cross input cycles.

The reciprocal movement of the tray 162, as discussed above, results in freezing the water about the fingers 84, as illustrated in FIG. 16, so that gases in solution can escape. The dipping motion produced by reciprocating movement of the tray 162 relative to the fingers 84 provides a smooth ice body B with a crystal clear appearance. This reciprocating motion serves to polish the ice surface while it is freezing and mixes the bulk water it is freezing from to maintain uniform temperature in the bath. The bath is prevented from freezing by the tray heater output 318 being periodically energized as required and the conductive pins 160 being in connection with the blades 220 during the dipping operation.

Figure 11:
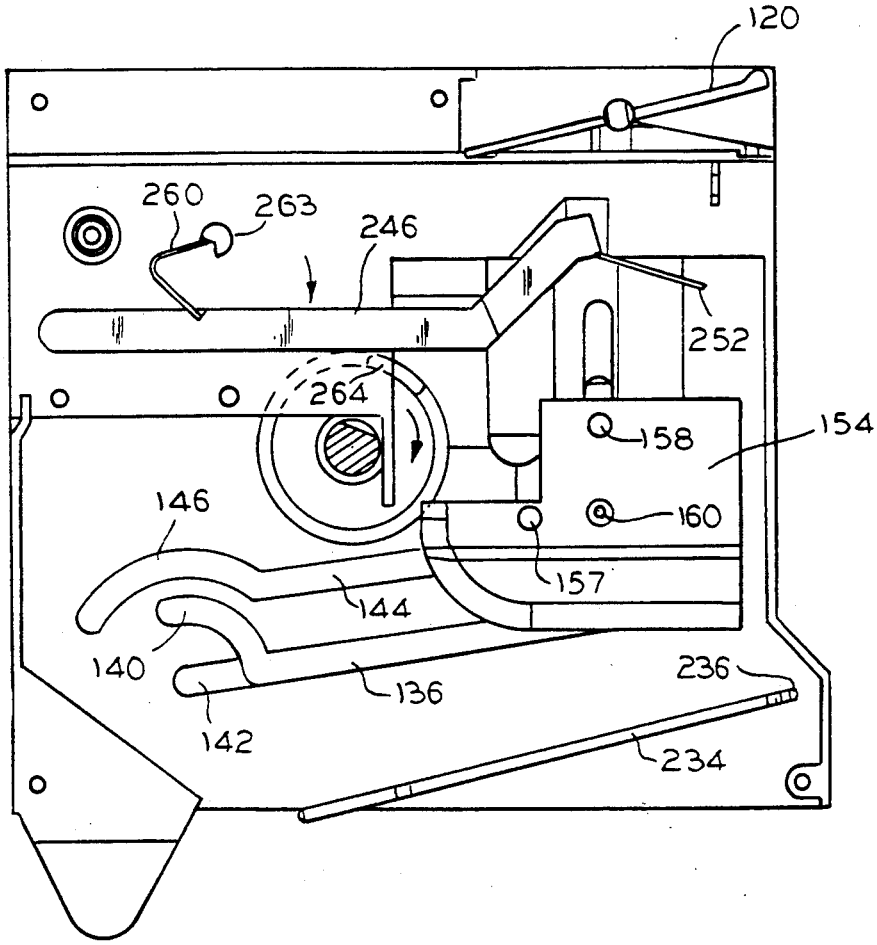
FIG. 11 is a view similar to that of FIG. 9 with the tray support in the bottom dip position.

In accordance with an exemplary embodiment of the invention, the dip cycle continues for approximately 70 minutes of vertical, reciprocal up and down movement. During the entire dipping cycle the blower motor output 316 is energized to operate the motor 92. Because the damper 120 is in the open position, as illustrated in both FIGS. 9 and 11, the blower motor 92 circulates freezer compartment air through the fingers 84, as illustrated in FIG. 16. An ice body B gradually builds upon on the finger 84 as also illustrated. During such time, the stripper blades 252 are positioned above the ice body B owing to operation of the cam actuator 264 during all times in the dipping cycle as illustrated in FIGS. 9, 11 and 16. Also, the opening provided by the damper 120 provides air system flow from below the damper 120 providing slightly colder air during compressor off cycles.

Since both ends of the carrier 134 are driven by the cams 180 and 182, the tray 162 is provided with good stability and uniform motion of water about the fingers 84.

Figure 12:
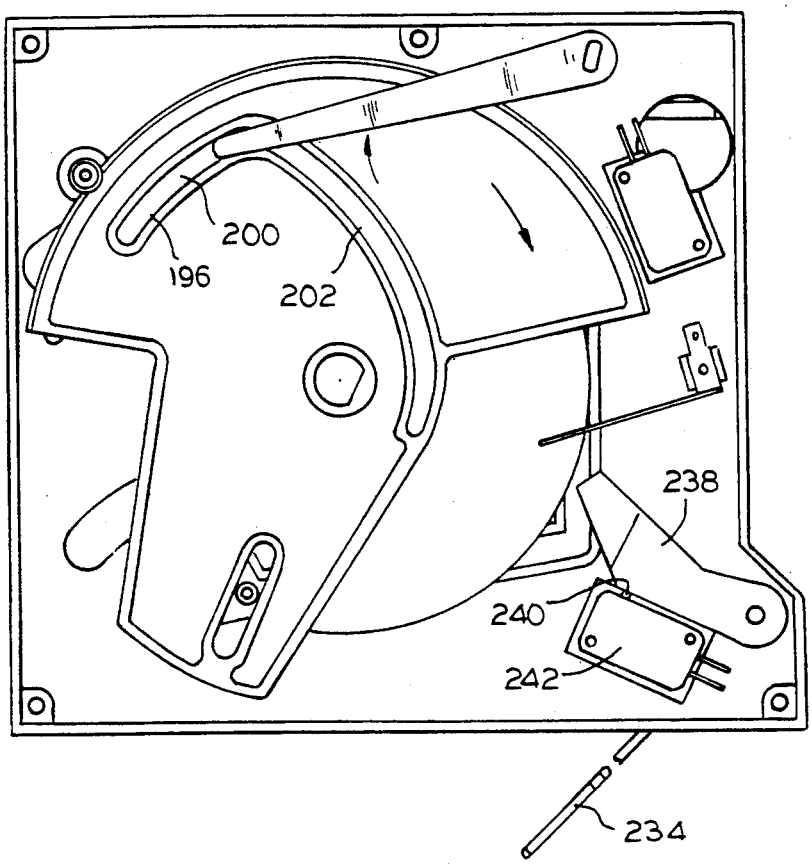
FIG. 12 is a view similar to that of FIG. 8 with the tray support in a harvest and park position.

At the completion of the seventy minute cycle time, control advances to a block 362 to begin a harvest cycle. The harvest begins by energizing the tray motor down output 310 to cause repositioning of the carrier 134 and thus tray 162 to withdraw the water from adjacent the fingers 84. The specific cycle followed depends upon the volume of ice already contained in the container assembler 28. During the dipping cycle, the cam 180, particularly the arm 194, operates to maintain the lever 238 and thus bin arm 234 in the up position, as illustrated in FIGS. 8–11. During the harvest cycle, the cam 180 is rotated in the clockwise direction, as illustrated in FIG. 12, until the lever 238 is released to provide downward, vertical movement of the bin arm 234. If the container assembly 28 is full, then the bin arm 234 will not move vertically downwardly sufficiently for the lever 238 to actuate the switch 242. If an insufficient supply of ice is contained in the container assembly 28, then the switch 242 will be actuated, as illustrated in FIG. 12. A decision block 364 determines if the ice bin is full in accordance with the status of the switch 242. If the ice bin is not full, then control advances to a block 366 to complete the normal harvest cycle.

Figure 17:
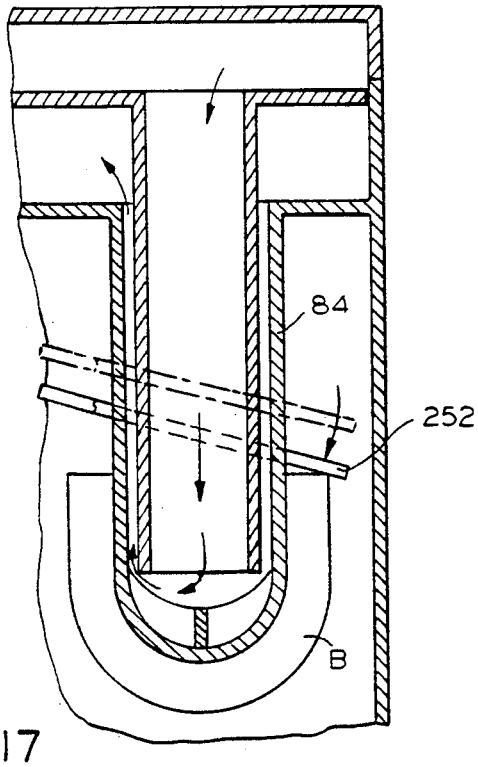
FIG. 17 is a view similar to that of FIG. 16 at the beginning of a harvest cycle.
Figure 18:
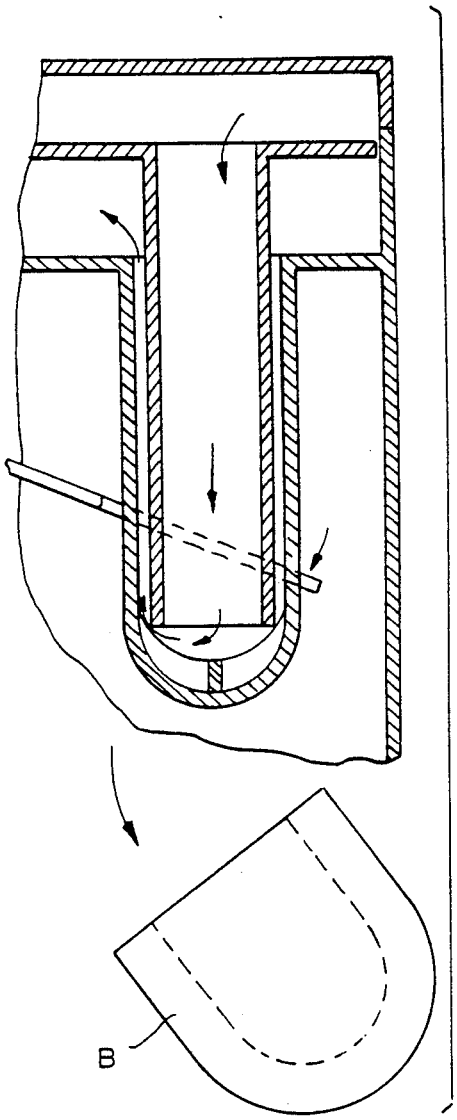
FIG. 18 is a view similar to that of FIG. 17 at the completion of the harvest cycle.

The harvest cycle operates by moving the tray carrier 134 to the park position illustrated in FIG. 13. With the tray carrier 134 in the park position, there is no vertical obstruction between the fingers 84 and the container assembly 28. Incident to the carrier 134 being moved to the parked position, the cam actuator 264 releases the stripper 244 which is biased by the springs 260 and 262 downwardly about the pivot pins 254 and 256. As a result, the stripper blades 252, which are inherently flexible, move downwardly so that they rest on top of the ice bodies B as illustrated in FIG. 17 to individually provide downward vertical pressure on each of the ice bodies B. Also, as the cam 180 rotates to the park position the arm 206 positions the damper 120 in the closed position as illustrated in FIG. 13. Also, the harvest heater 128 is energized by energizing the harvest heater output 314. Consequently, heated air is cycled through the fingers 84 via the flow paths illustrated in FIG. 17. This heated air acts to slightly thaw the insides of the ice bodies B to release them from the fingers 84 in connection with the downward pressure of the stripper blades 252.

Because the bottom of the ice maker 30 is open, refrigerated air in the freezer compartment 16 circulates in the area surrounding the fingers 84 and ice bodies B. This chilled air dries the outer surface of the ice body B as by freezing any water remaining on the same as the air is at a temperature below 32° F.

The above harvest cycle continues until the temperature sensed by the sensor 306 reaches an elevated temperature indicating the harvest cycle is complete. Particularly, during the heating cycle, the circulating air is heated by the heater 128. However, the frozen ice bodies on the fingers 84 chill the air as it is passes through the fingers 84. Once all of the ice bodies have been harvested and thus no ice bodies B remain on any fingers 84, then the temperature will rapidly increase as there is no cooling source. At such time, the ice is assumed to be harvested and the harvest heater 128 is turned off by deenergizing the heater output 314. Normally, this harvest cycle time can be expected to be on the order of approximately five minutes.

Once the harvest cycle is complete, then control proceeds to begin another dip cycle by returning to the block 358, discussed above.

If the ice bin is full, as determined at the decision block 364, then control advances to a block 368 at which time the blower motor output 316 is deenergized to turn off the blower motor 92 and the cams 180 and 182 drive the carrier 134 to dump water from the tray 162. If no further ice is desired, then it is preferred to dump any water from the tray 162 so that it does not sit there for an extended length of time which could result in stale water and/or freeze up of the water. To do so, the cams 180 and 182 drive the carrier 134 to the position illustrated in FIG. 15. Particularly, the support pin 157 is moved to the furthest position of the slot 142 preventing further horizontal movement. At such time, the pins 160 and 158 are in the arcuate track portions 140 and 146 resulting in pivotal movement of the carrier 134 about the pin 157. This pivotal movement results in the tipping of the tray carrier 134 as illustrated in FIG. 15 causing any water in the tray 162 to dump into the trough 270. The water is then disposed to, for example, a defrost water pan (not shown).

Once the carrier 134 is in the dump position, as illustrated in FIG. 15, then the tray motor "down" output 310 is deenergized. With the water from the tray 162 having been dumped, control advances to a block 370 which moves the carrier 134 to the park position of FIG. 13. Particularly, the tray motor "up" output is energized to pivot the support clockwise as illustrated in FIG. 13 until the support is in the park position shown in FIG. 13. As will be appreciated, the ice maker is effectively disabled at such time.

With the carrier 134 in the park position, control advances to a decision block 372 which determines if ice is needed. Particularly, the status of the bin arm switch 242 is continually evaluated to determine if ice is needed. If not, the control waits at a block 374 for a preselected amount of time and then returns to the block 372. This loop continues until the bin arm 234 drops down as by ice having been removed from the container assembly 30 at which time ice is needed as determined at the decision block 372. If so, then control returns to the decision block 364 at which time the harvest cycle begins in order to ensure that all ice bodies B are removed from the fingers 84.

During the dipping cycle, only a portion of the water in the tray 162 is used to form the ice bodies B. At the beginning of the dip cycle, the tray 162 is filled to replenish the water used. However, the solids concentration in the tray water will build up with each successive cycle as the purer water is frozen from solution. To ensure that clear ice is provided throughout operation, it is desirable to occasionally dump the residual water in the tray to get rid of the solids, i.e., the minerals and impurities that have built up in the freezing bath. In accordance with the invention, whenever a defrost cycle is initialized, power is removed from the ice maker and control is restarted at the block 350 at the completion of the defrost cycle. Alternatively, the control is modified to provide that after a select number of dip cycles the water is dumped. For example, a routine can be added after the block 366 of FIG. 7 to determine how many continuous cycles have been implemented since the last time the water is dumped and if the number exceeds a select number then control could proceed to the block 368 to dump water prior to beginning the next dip cycle.

The freezer compartment temperature determines the thickness of the ice bodies. For example, a normal size ice body resulting at a normal freezer compartment temperature is illustrated in FIG. 19. This ice body has a height H1 and thickness T1. If the available temperature is higher, then the initial thickness will be less and might be on order of the thickness T2 illustrated in FIG. 21. However, the height will not change as height is determined by the level of water in the tray 162. However, with a thinner ice body less water is used. When the fixed quantity of water is added to the tray 162 at the next fill, the level of water in the tray 162 increases so that with each successive cycle, the height of the ice body will increase up to the level H2 illustrated in FIG. 21. This is a self-compensating feature which provides a uniform, average volume ice body over long periods of time.

Conversely, under lower temperature conditions a thicker ice body such as on the order of thickness T3 illustrated in FIG. 20 results. This results in more water being used than is added to each cycle so that eventually a shorter ice body having a height H3, such as illustrated in FIG. 20 results. This illustrates the self-compensating feature under colder freezer conditions.

In order to provide a more uniform size ice body under extreme temperature conditions, an adaptive control may also be utilized. Under normal freezer conditions, the size of the ice body is a function of dip time. However, since the size may vary depending on freezer air temperature extremes, as discussed above, the dip time can be varied in response to temperature.

Figure 22:
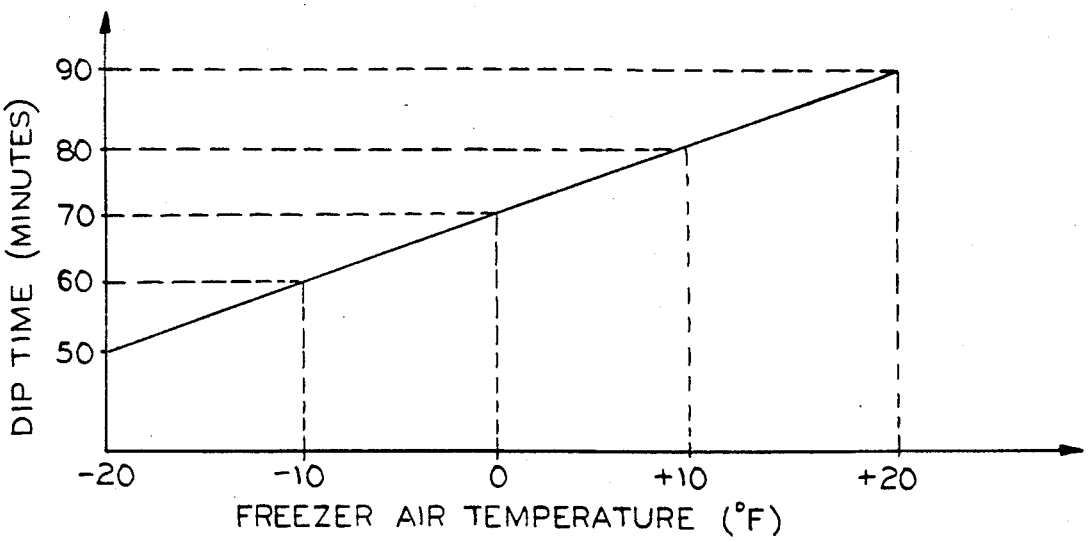
FIG. 22 is a curve illustrating data stored by the microprocessor for implementing an adaptive control scheme for providing uniform sized ice bodies.

With reference to FIG. 22, a curve illustrates the relationship between freezer air temperature and dip time to maintain a constant cube size in accordance with the invention. For example, at a freezer air temperature of 0°F., the dip time of 70 minutes discussed above is used. If the freezer air temperature is +20°F., then a dip time of 90 minutes is used, while with a freezer air temperature −10° F. a 60 minute dip time is used. This approach provides ice body size independent of freezer temperature.

Figure 23:
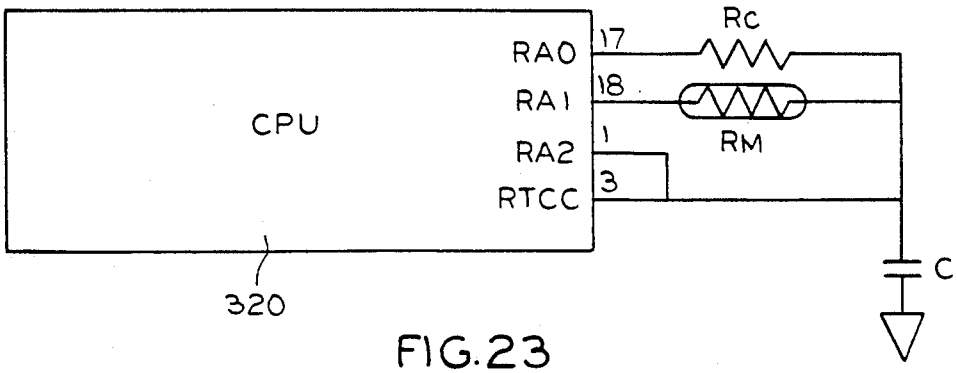
FIG. 23 is an electrical schematic illustrating a modification to the schematic of FIG. 6 used with the adaptive control scheme.

With reference to FIG. 23, a temperature sensing circuit is illustrated for determining freezer compartment temperature. This control uses the microcontroller 320 discussed above. The additional inputs and outputs shown are for use in connection with the adaptive control. The microcontroller 320 is connected to a parallel calibration resistor RC and a thermistor represented by a resistor RM. The opposite side of the resistors RC and RM are connected to capacitor C The junction between the resistors RC and RM and the capacitor C is also connected to the microcontroller 320. All of the components illustrated are contained on the control board 90, see FIG. 4.

Figure 24:
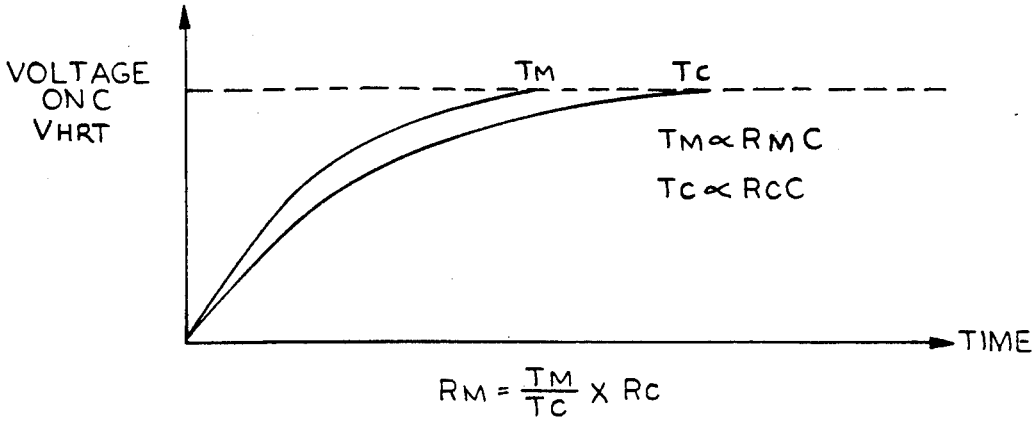
FIG. 24 is a graph illustrating a relationship between time and temperature for the adaptive control scheme.

During the ice making process, specifically during the dip cycle, freezer air flows across the thermistor RM. As the resistance of the thermistor RM changes with temperature, the capacitive charging circuit converts thermistor resistance to time which can be measured by the microcontroller 320. To do so, a reference voltage is applied to the calibration resistor RC which is charged until a threshold is measured by the microcontroller. This generates a software calibration value used to calibrate out most circuit errors. The capacitor C is then discharged and the reference voltage is applied to the thermistor resistance RM. The time to trip the preset threshold is measured and compared to the calibration value to determine the actual resistance using a stored relationship as illustrated in FIG. 24. The temperature is then calculated using a lookup table of thermistor resistance versus temperature stored in the microcontroller memory. This temperature is then used in conjunction with the curve of FIG. 22 to determine the dip time for the dip cycle.

Ideally, the temperature should be sensed a number of times during the dip cycle and the running average used to adjust the dip period time longer or shorter for the next dip cycle depending on the measured air temperature.

Figure 25:
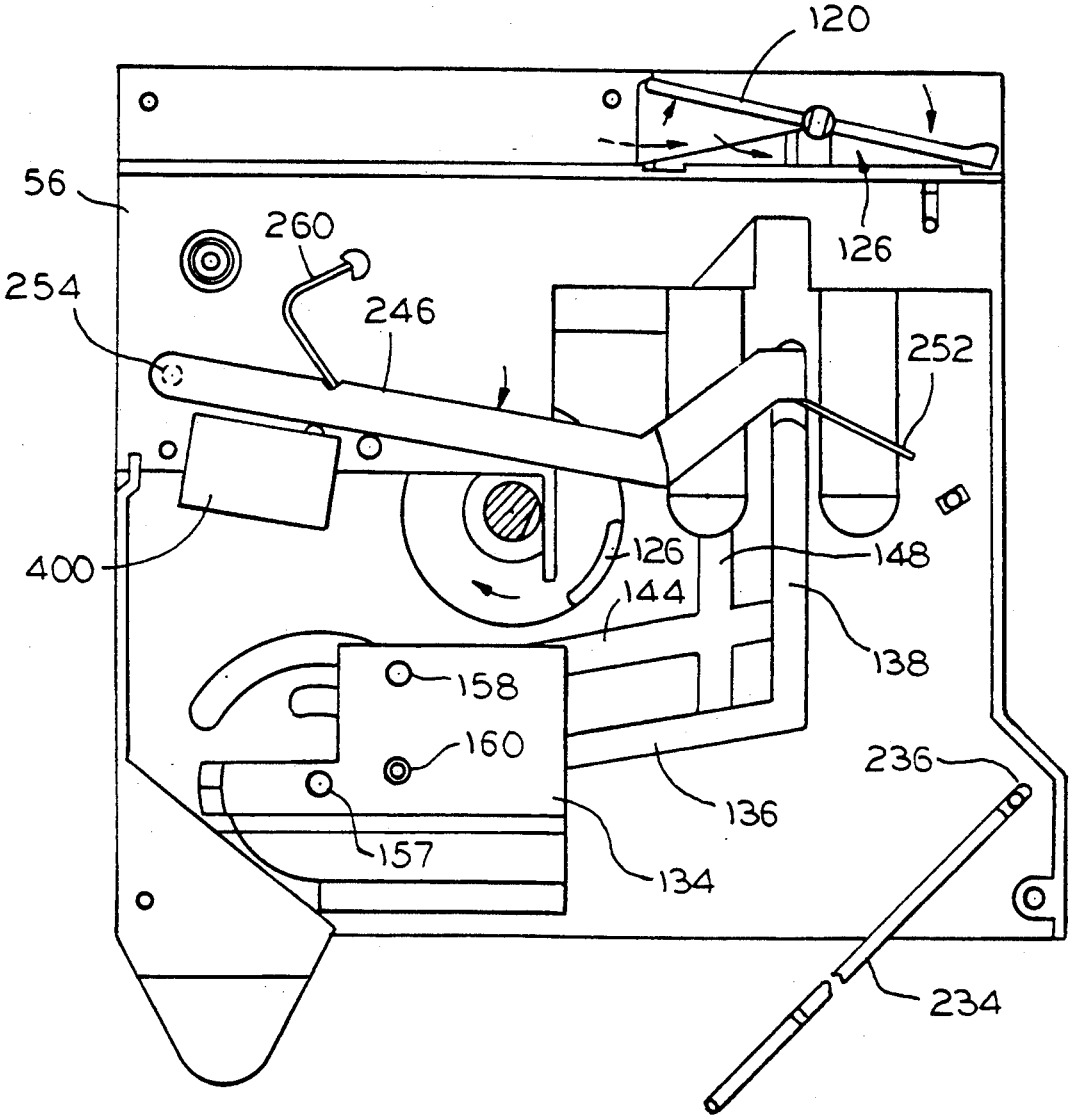
FIG. 25 is a view similar to that of FIG. 13 showing an alternative embodiment.

As discussed above, relative to the flow chart of FIG. 7, harvest heat is terminated by a select temperature above the temperature needed to release the ice bodies. To ensure complete harvesting under extreme operating conditions, this select temperature must necessarily be relatively high. With reference to FIG. 25, an alternative embodiment is illustrated which uses stripper motion to terminate harvest heat.

FIG. 25 illustrates the ice maker 30 in the harvest position, similar to FIG. 13. The ice maker includes a harvest switch 400 mounted to the lower plenum housing 56 in proximity to the stripper front arm 246. At the beginning of the harvest cycle, see FIG. 11, the stripper 244 is elevated and the switch 400 is in a neutral condition. Upon complete harvesting of the ice bodies the stripper 244 pivots under bias of the springs 260 and 262 to actuate the switch 400.

The switch 400 includes a normally open contact 402 connected in parallel with the thermistor 306, see FIG. 6. When the switch 400 is actuated the contact 402 is closed and the microcontroller 320 sees a low resistance at its input. A low resistance represents a high temperature. Thus, in following the flow chart of FIG. 7, and particularly block 366, harvesting would continue until either an actual high temperature is sensed by the thermistor 306 or the contact 402 closes. With the switch 400, the select temperature can be set at a higher value so that if the stripper 244 ever becomes jammed, then the thermistor 306 acts as a high temperature limit at the select temperature value.

Thus, in accordance with the invention, a clear ice maker is provided which reciprocally moves a volume of water up and down relative to a refrigerated support to form ice bodies. The pure water in the volume freezes first, with solids in the solution settling to the bottom of a water tray. The water tray is eventually dumped as concentration increases to maintain the crystal clearness of the formed ice bodies.

The illustrated embodiment of the invention is illustrative of the broad inventive concepts comprehended hereby.

We claim:

1. An ice maker for making clear ice bodies comprising:

a support arranged to have an ice body formed thereon;

means for refrigerating said support to a below freezing temperature;

a container adapted to hold a body of water;

means for moving the container to move liquid water contained therein uniformly about said support between a top dip position and a bottom dip position suitable to cause a clear substantially symmetrical ice body to build up outwardly on the refrigerated support, the ice body being at least partly immersed in the container during movement of the container between the dip positions, said movement polishing the ice body while it is freezing and mixing the liquid water in the container to maintain uniform water temperature;

means for causing repositioning of the container to withdraw the water in the container from adjacent the support upon completion of build up of the ice body; and means for causing harvesting of the ice body from the support.

2. The ice maker of claim 1 wherein said support comprises a hollow member and said means for refrigerating said support comprises means for conducting refrigerated fluid therethrough.

3. The ice maker of claim 1 wherein said support comprises a depending member and said container comprises an upwardly opening container.

4. The ice maker of claim 1 wherein said means for moving the container comprises means for reciprocating said container.

5. The ice maker of claim 1 wherein said support comprises a depending member and said container comprises an upwardly opening container and said means for moving the container comprises means for vertically reciprocating said container.

6. The ice maker of claim 1 wherein said means for causing harvesting of the ice body comprises means for heating the support.

7. An ice maker for making clear ice bodies comprising:

a support arranged to have an ice body formed thereon;

means for refrigerating said support to a below freezing temperature;

a container adapted to hold a body of water;

means for moving the container to move liquid water contained therein uniformly about said support suitable to cause a clear substantially symmetrical ice body to build up outwardly on the refrigerated support;

means for causing repositioning of the container to withdraw the water in the container from adjacent the support; and means for causing harvesting of the ice body from the support wherein said means for causing harvesting of the ice body comprises means for heating the support and pressure means for urging the ice body from the support.

8. The ice maker of claim 7 wherein said means for causing harvesting of the ice body comprises means for heating the support and resilient pressure means for urging the ice body from the support.

9. An ice maker for making clear ice bodies comprising:

a support arranged to have an ice body formed thereon;

means for refrigerating said support to a below freezing temperature;

a container adapted to hold a body of water;

means for moving the container to move liquid water contained therein uniformly about said support suitable to cause a clear substantially symmetrical ice body to build up outwardly on the refrigerated support;

means for causing repositioning of the container to withdraw the water in the container from adjacent the support;

means for causing harvesting of the ice body from the support; and means for dumping the water from the container after a preselected number of ice body making cycles of operation of the ice maker.

10. An ice maker for making clear ice bodies comprising:

a support arranged to have an ice body formed thereon;

means for refrigerating said support to a below freezing temperature;

a container adapted to hold a body of water;

means for moving the container to move liquid water contained therein uniformly about said support suitable to cause a clear substantially symmetrical ice body to build up outwardly on the refrigerated support;

means for causing repositioning of the container to withdraw the water in the container from adjacent the support;

means for causing harvesting of the ice body from the support; and means for collecting the harvested ice bodies and means for dumping the water from the container as an incident of the collecting means having a preselected full level of ice bodies therein.

11. The ice maker of claim 1 wherein said ice forming portion comprises a tubular member and said means for refrigerating said ice forming portion comprises means for conducting refrigerated fluid therethrough.

12. The ice maker of claim 1 wherein said ice forming portion comprises a tubular member and said means for causing harvesting of the ice body comprises pressure means movable coaxially of the tubular member for urging the ice body therefrom.

13. An ice maker for making clear ice bodies comprising:

a support arranged to have an ice body formed thereon;

means for refrigerating said support to a below freezing temperature;

a container adapted to hold a body of water;

means for moving the container to move liquid water contained therein uniformly about said support suitable to cause a clear substantially symmetrical ice body to build up outwardly on the refrigerated support;

means for causing repositioning of the container to withdraw the water in the container from adjacent the support; and means for causing harvesting of the ice body from the support, including means for drying the outer surface of the ice body subsequent to the ice body being freed of contact with the liquid water.

14. The ice maker of claim 13 further including means for drying the outer surface of the ice body subsequent to the ice body being freed of contact with the liquid water, comprising means for contacting said outer surface with air at a temperature below 32 degrees Fahrenheit.

15. An ice maker for making clear ice bodies comprising:

a support arranged to have an ice body formed thereon;

means for refrigerating said support to a below freezing temperature;

a container adapted to hold a body of water;

means for moving the container to move liquid water contained therein uniformly about said support suitable to cause a clear substantially symmetrical ice body to build up outwardly on the refrigerated support;

means for causing repositioning of the container to withdraw the water in the container from adjacent the support; and means for causing harvesting of the ice body from the support, wherein said means for moving liquid water about said ice forming portion includes means for utilizing the same water to form a plurality of ice bodies in a plurality of ice body making cycles and means for replacing the water with fresh water after a preselected number of ice body making cycles have been completed.

16. An ice maker for making clear ice bodies comprising:

a support arranged to have an ice body formed thereon;

means for refrigerating said support to a below freezing temperature;

a container adapted to hold a body of water;

means for moving the container to move liquid water contained therein uniformly about said support suitable to cause a clear substantially symmetrical ice body to build up outwardly on the refrigerated support;

means for causing repositioning of the container to withdraw the water in the container from adjacent the support;

means for causing harvesting of the ice body from the support; and a collection receptacle for receiving the harvested ice bodies and means for completely replacing the water with fresh water after a preselected number of ice bodies have been formed from the water as an incident of a preselected number of harvested ice bodies being contained in the collection receptacle.

17. An ice maker for making clear ice bodies comprising:

a support arranged to have an ice body formed thereon;

means for refrigerating said support to a below freezing temperature;

a container adapted to hold a body of water;

means for reciprocally vertically moving the container to move liquid water contained therein uniformly about said support suitable to cause a clear substantially symmetrical ice body to build up outwardly on the refrigerated support;

means for causing repositioning of the container to withdraw the water in the container from adjacent the support; and means for causing harvesting of the ice body from the support including means for firstly freeze drying the outer surface of the ice body and subsequently warming the support to free the ice body therefrom.

18. The ice maker of claim 17 wherein flexible means are provided for urging the ice body from the support upon freeing of the ice body from the support by the warming of the support.

19. An ice maker for making clear ice bodies comprising:

a support arranged to have an ice body formed thereon, comprising a hollow plastic tubular member open at a near end and closed at a distal end, and a tube coaxially positioned in said tubular member to maintain a uniform space therebetween;

refrigeration means for conducting refrigerated fluid through the open end of said tubular member to refrigerate said uniform space between said tube and said support to a below freezing temperature;

a container adapted to hold a body of water; and means for moving the container to move liquid water contained therein uniformly about said support suitable to cause a clear substantially symmetrical ice body to build up outwardly on the refrigerated support adjacent the closed end of said tubular member.

20. An ice maker for making clear ice bodies comprising:

a support arranged to have an ice body formed thereon, comprising a hollow plastic tubular member open at a near end and closed at a distal end;

refrigeration means for conducting refrigerated fluid through the open end of said tubular member to refrigerate said support to a below freezing temperature, wherein said refrigeration means comprises means for conducting refrigerated air through said tubular member;

a container adapted to hold a body of water; and means for moving the container to move liquid water contained therein uniformly about said support suitable to cause a clear substantially symmetrical ice body to build up outwardly on the refrigerated support adjacent the closed end of said tubular member.

21. The ice maker of claim 20 wherein said refrigeration means comprises means for drawing refrigerated air from outside of said ice maker.

22. The ice maker of claim 19 wherein said support comprises a plurality of depending tubular members and said container comprises an upwardly opening container.

23. The ice maker of claim 19 further comprising means for causing harvesting of the ice body from the tubular member.

24. The ice maker of claim 23 wherein said means for causing harvesting of the ice body comprises means for conducting heated fluid through the open end of said tubular member to heat said support to an above freezing temperature.

25. The ice maker of claim 23 wherein said means for causing harvesting of the ice body comprises means for conducting heated fluid through the open end of said tubular member to heat said support to an above freezing temperature and pressure means for urging the ice body from the support.

26. The ice maker of claim 25 further comprising means for sensing if said pressure means have urged the ice body from the support and wherein said means for causing harvesting of the ice body further comprises means for terminating conduction of heated fluid through the open end of said tubular member responsive to the ice body being urged from the support as sensed by said sensing means.

27. An ice maker for making clear ice bodies comprising:

a support arranged to have an ice body formed thereon;

means for refrigerating said support to a below freezing temperature;

a container adapted to hold a body of water;

means for moving the container to move liquid water contained therein uniformly about said support suitable to cause a clear substantially symmetrical ice body to build up outwardly on the refrigerated support;

means for heating the container to prevent freezing of water contained therein; and means for causing harvesting of the ice body from the support.

28. The ice maker of claim 27 further comprising storage means for causing repositioning of the container to withdraw the water in the container from adjacent the support prior to harvesting of the ice body.

29. A refrigerator/freezer comprising:

a freezer compartment and a refrigerator compartment;

means for refrigerating air in said compartments;

an ice maker in said freezer compartment for making crystal clear ice bodies from a supply of water in said freezer compartment, including means for forming ice bodies as by freezing a select portion of the water using refrigerated air in the freezer compartment, the select portion of the water being substantially free of minerals and impurities, whereby the frozen ice bodies are substantially crystal clear and free of entrapped minerals and impurities, said ice maker further including a tray holding the supply of water and means for preventing freezing of water remaining in the tray.

30. The refrigerator/freezer of claim 29 wherein said ice maker further comprises means for periodically dumping water remaining in the tray.

31. A refrigerator/freezer comprising:

freezer compartment and a refrigerator compartment;

means for refrigerating air in said compartments;

an ice maker in said freezer compartment for making crystal clear ice bodies from a supply of water in said freezer compartment, including means for forming ice bodies as by freezing a select portion of the water using refrigerated air in the freezer compartment, the select portion of the water being substantially free of minerals and impurities;

a container in said freezer compartment for storing formed ice bodies;

means for delivering ice bodies from said container to a dispenser mounted in a door of the freezer compartment, whereby the delivered ice bodies are substantially crystal clear and free of entrapped minerals and impurities, said ice maker further including a tray holding the supply of water and means for preventing freezing of water remaining in the tray.

32. For use in a refrigeration apparatus including freezer compartment refrigerated by forced, refrigerated air, an ice maker for making crystal clear ice bodies comprising:

a support in said freezer compartment arranged to have an ice body formed thereon;

means for refrigerating said support to a below freezing temperature using said refrigerated air;

a container adapted to hold a body of water;

means for moving the container to move liquid water contained therein uniformly about said support suitable to cause a clear substantially symmetrical ice body to build up outwardly on the refrigerated support;

means for causing repositioning of the container to withdraw the water in the container from adjacent the support; and means for causing harvesting of the ice body from the support to a container in said freezer compartment.

33. The ice maker of claim 32 wherein said support comprises a hollow member and said means for refrigerating said support comprises means for conducting refrigerated air from said freezer compartment therethrough.

* * * * *